United States Patent [19]

Yamauchi

[11] Patent Number: 5,000,729

[45] Date of Patent: Mar. 19, 1991

[54] BAG FOLDING MACHINE

[75] Inventor: Sachio Yamauchi, Itoshima, Japan

[73] Assignee: Taiyo Plant Co., Ltd., Osaka, Japan

[21] Appl. No.: 399,794

[22] Filed: Aug. 28, 1989

[30] Foreign Application Priority Data

Aug. 31, 1988 [JP] Japan ..... 63-219176

[51] Int. Cl.[5] ..... B65H 45/16; B65H 45/101; B31B 23/26

[52] U.S. Cl. ..... 493/359; 493/418; 493/433

[58] Field of Search ..... 493/356, 357, 359, 418, 493/425, 432, 433

[56] References Cited

U.S. PATENT DOCUMENTS

| | | | |
|---|---|---|---|
| 843,781 | 2/1907 | Wheeler | 493/418 |
| 940,933 | 11/1909 | Klein | 493/418 |
| 2,092,952 | 9/1937 | Campbell | 493/418 |
| 2,165,786 | 7/1939 | Christman | 493/418 |
| 2,872,186 | 2/1959 | Raybuck | 493/418 |
| 4,770,402 | 9/1988 | Couturier | 493/357 |

*Primary Examiner*—William E. Terrell

*Attorney, Agent, or Firm*—Jordan and Hamburg

[57] ABSTRACT

A bag folding machine for folding thin plastic bags, such as polyethylene bags, comprises two bag folding arrangements which substantially are made of a pair of folding drums provided respectively with longitudinal grooves, swing grippers and thrusting and cutting blades. The phase difference between the folding drums is determined so that the longitudinal grooves and the thrusting and cutting blades of one folding drum of the two folding drums coincide with the thrusting and cutting blades and longitudinal grooves of the other folding drum, respectively, at the point of tangency of the folding drums. Due to such construction, the machine is capable of alternately folding thin plastic bags in two so that the trailing half of the preceding folded bag folded by one of the bag folding arrangements and the leading half of the succeeding folded bag folded by the other bag folding arrangement overlap each other.

3 Claims, 25 Drawing Sheets

BAG FOLDING MACHINE

BACKGROUND OF THE INVENTION

1. The present invention relates to a bag folding machine for folding thin plastic bags, such as polyethylene bags, comprising two bag folding arrangements which alternately fold thin plastic bags in two so that the trailing half of the preceding folded bag folded by one of the bag folding arrangements and the leading half of the succeeding folded bag folded by the other bag folding arrangement overlap each other.

2. Description of the Prior Art

Generally, an elongate sheet of successive polyethlene bags demarcated with perforations is supplied in a roll. In using the polyethylene bags wound in a roll to put an article, such as food, in the polyethylene bag each polyethylene bag must be torn off along the perforations with both hands. Furthermore: such a roll of continuous polyethytene bags must be supported rotatably on a stand and such an arrangement is inadequate for the household use of polyethylene bags. Accordingly, a package containing individual polyethylene bags so that the polyethylene bags can readily be pulled out from the package one at a time has been desired.

SUMMARY OF THE INVENTION

Accordingly, it is an object of the present invention to provide a bag folding machine capable of individually folding thin plastic bags, such as polyethylene bags, wherein when the such bags are packed in the package, the bag can be readily pulled out from the package one at a time and the subsequent bag is pulled out partially for the next use.

In one aspect of the present invention, a bag folding machine comprises a pair of folding drums of equal diameters journaled on a frame for rotation, respectively, in opposite directions, and characterized in that each of the folding drums is provided with a pair of longitudinal grooves formed in the circumference thereof at positions diametrically opposite to each other, a pair of swing grippers disposed, respectively in the longitudinal grooves to hold bags, and a pair of thrusting and cutting blades disposed on the circumference thereof, respectively, at positions diametrically opposite to each other, the phase difference between the pair of folding drums is determined so that the longitudinal grooves of one of the folding drums coincide, respectively, with the thrusting and cutting blades of the other folding drum at the point of tangency of the folding drums, and the folding drum are capable of attracting bags to their circumferences by suction.

The bag folding machine is characterized also by pressing arms disposed, respectively, below the pair of folding drums so as to operate alternately for up-and-down swing motion to press down folded bags.

The bag folding machine is characterized also by auxiliary thrust rollers provided in combination, respectively, with the pair of folding drums to thrust the middle portion of a bag into each longitudinal groove of the corresponding folding drum.

The bag folding machine is characterized also in that suction holes are formed in the side surfaces of each of the thrusting and cutting blades to suck air therethrough, and blowing holes are formed in the circumferences of the pair of folding drums so as to be connected alternately to a vacuum pump and a compressor in synchronism with the rotation of the pair of folding drums.

The bag folding machine is characterized also in that the swing grippers provided in the longitudinal grooves are biased constantly in the closing direction by springs.

The bag folding machine is characterized further by a pair of guide plates having a shape resembling the letter L and disposed under the pair of folding drums so as to receive bags folded alternately in opposite directions so as to overlap partially each other and be delivered alternately from the pair of folding drums therebetween.

Thus, according to the present invention, the pair of folding drums of equal diameters are journaled adjacently for rotation, respectively, in opposite directions, each of the pair of folding drums is provided with the longitudinal grooves, the swing grippers disposed in the longitudinal grooves, and the thrusting and cutting blades, the angular phase difference between the pair of folding drums is determined so that the longitudinal grooves of one of the folding drums coincide, respectively, with the thrusting and cutting blades of the other folding drum and the folding drums are capable of attracting bags to their circumferences by suction.

Accordingly, when elongate sheet of successive bags are fed via the auxiliary thrust rollers to the folding drums so that the leading edges of the sheets are attracted by suction to the folding drums at positions corresponding to the respective thrusting and cutting blades, respectively, the leading edge of the bag on one of the folding drums meets the middle portion of the bag on the other folding drum at the point of tangency of the folding drums and, the middle portion of the bag on the other folding drum is folded and held by the swing gripper of the other folding drum. As the folding drums rotate further, the swing gripper of one of the folding drums is opened to release the folded bag and, at the same time, air is blown from the corresponding longitudinal groove in the circumference of the folding drum to separate the folded bag from the folding drum, so that the folded bag falls downward. Then, immediately after the folded bag has been separated from the folding drum, the pressing arm presses the folded portion of the bag. Thus, the folding drums deliver folded bags alternately to a place defined by guide plates under the folding drums, so that the folded bags are piled up regularly in place.

According to the present invention; each of bags formed by cutting and processing a tube is attracted to the circumference of the folding drum by suction so as to extend along the circumference of the folding drum between the thrusting and cutting blades, and then the bag is folded in two and held by the swing gripper of the other folding drum at the point of tangency of the folding drums. Thus, the bags are folded alternately by the pair of folding drums and the folded bags are held securely by the swing grippers. Therefore, the bags can be surely folded and the folded bags will never fall accidentally off the folding drums even if the bag folding machine operates at a high operating speed, so that the bag folding machine is able to operate at a high efficiency.

The pressing arms disposed below the corresponding folding drums deliver the folded bass successively separated from the folding drums regularly to the place under the pressing arms defined by the guide plates. Accordingly, high-speed bag folding operation can be surely achieved.

The auxiliary thrust rollers each for thrusting the middle portion of a bag in each of the grooves of the folding drums enable the smooth, continuous feed of bags to the folding drums.

The suction holes formed in the side surfaces of the thrusting and cutting blades enable the leading edge and trailing edge of a bag to be securely held in place by suction for conveying the bag. Furthermore, the blowing holes formed in the circumference of the folding drums ensure the smooth separation of folded bags from the folding drums.

Still further, constantly biasing the swing grippers in the closing direction by the springs further ensures the holding of bags on the folding drums and hence the bags never fall accidentally off the folding drums during the high-speed folding operation.

Furthermore, the place under the pair of folding drums defined by the guide plates having a shape substantially resembling the letter L to receive folded bags delivered alternately from the pair of folding drums enables the bags to be piled up regularly.

The bag folding machine in accordance with the present invention is simple in construction and capable of operating efficiently at a high speed for folding bags.

BRIEF DESCRIPTION OF THE DRAWINGS

The above and other objects, features and advantages of the present invention will become more apparent from the following description taken in conJunction with the accompanying drawings in which.

DETAILED DESCRIPTION OF THE PREFERRED EMBODIMENTS

First embodiment (FIGS. 1 to 13 )

Figure 1:
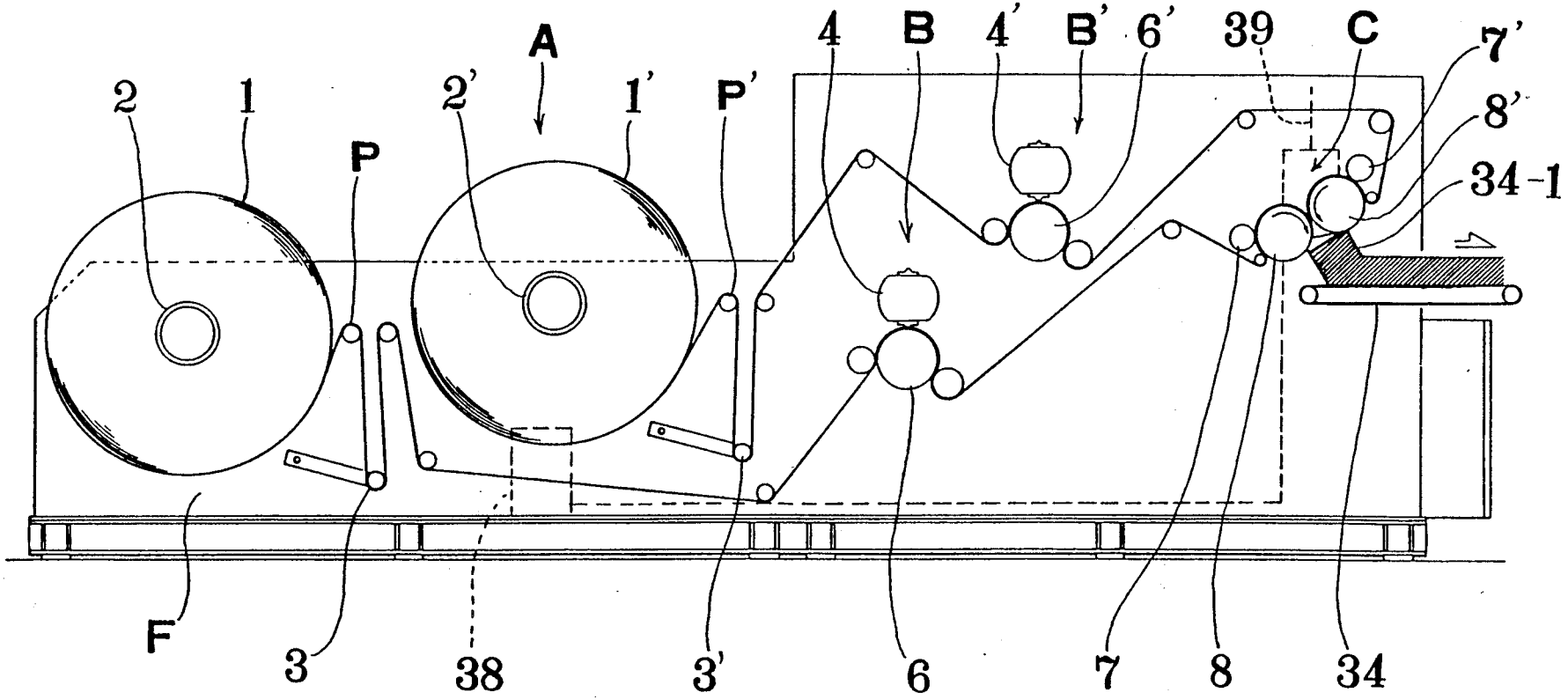
FIG. 1 is a side elevation of a bag folding machine in a first embodiment according to the present invention.

Referring to FIG. 1, a bag folding machine in a first embodiment according to the present invention comprises a tube feed section A for feeding tubes P and P', such as polyethylene tubes, sealing sections B and B', and a bag folding section C, which is the essential mechanism of the bag folding machine, arranged sequentially in that order.

In the tube feed section A, two tube rolls 1 and 1' are supported, respectively, on support shafts 2 and 2' journaled on a frame F. The tubes P and P' unwound from the tube rolls 1 and 1' are tightened properly, respectively, by tension rollers 3 and 3'.

The sealing section B comprises a sealing heater 4 and a feed roller 6 disposed opposite to the sealing heater 4 for a cooperative sealing operation to form sealed portions 5 ( refer to FIG. 12) across the tube P at regular intervals in the tube P as the tube travels between the sealing heater 4 and the feed roller 6.

The sealing section B' is entirely the same as the sealing section B in construction and function; the sealing section B' forms sealed potions 5 ( refer to FIG. 12) in the tube P'.

Figure 2:
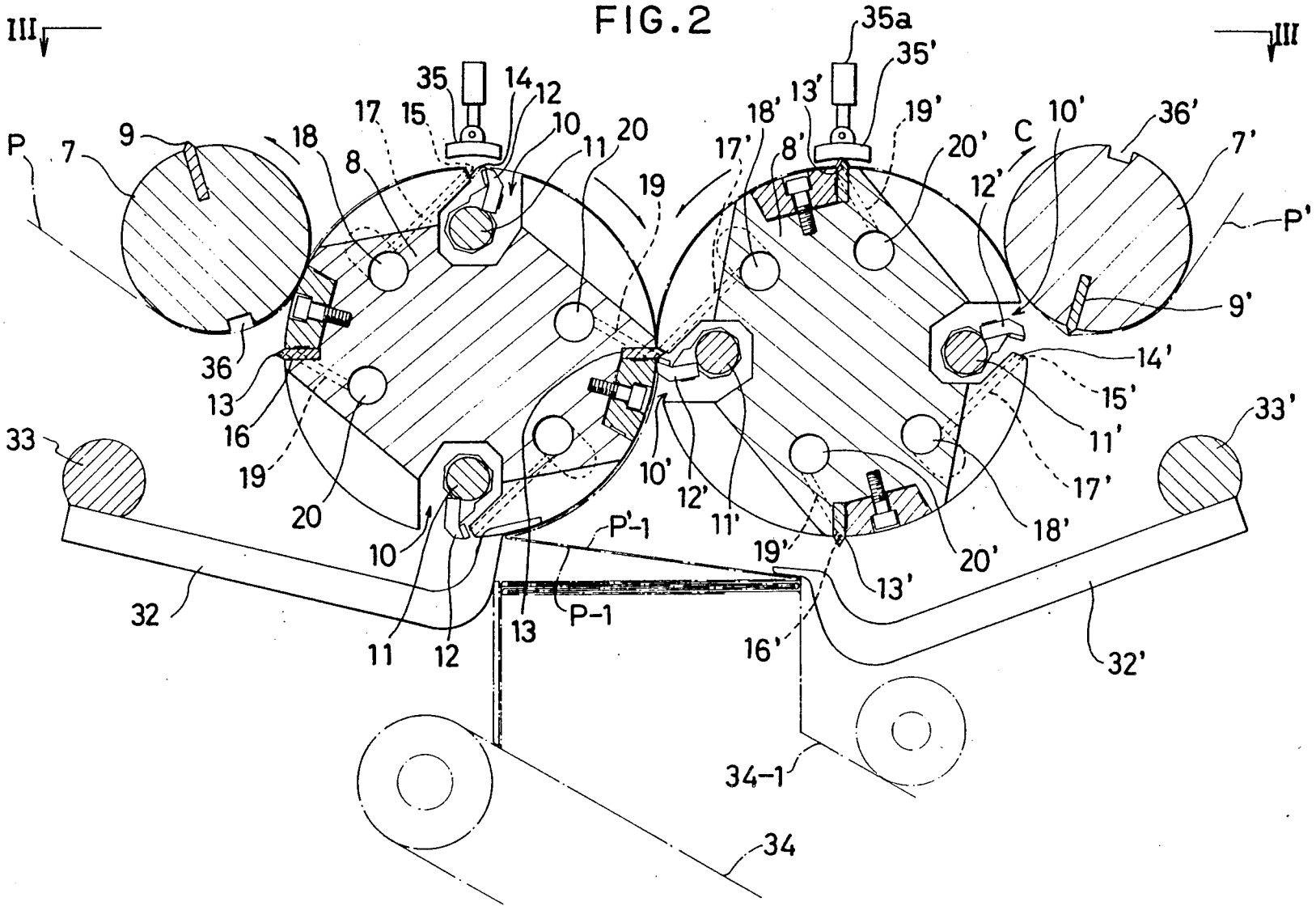
FIG. 2 is an enlarged fragmentary sectional view of an essential portion of the bag folding machine of FIG. 1.

Referring to FIG. 1 and FIG. 2, the bag folding section C comprises a first folding drum 8, a second folding drum 8' disposed adjacently to the folding drum 8, and auxiliary thrusting rollers 7 and 7', which are the same in construction and function, disposed in combination, respectively, with the folding drums 8 and 8'.

The auxiliary thrusting rollers 7 and 7' are provided, respectively, with thrust blades 9 in the respective circumferences thereof.

The tubes P and P' are fed to the first folding drum 8 and the second folding drum 8', respectively, by way of the auxiliary thrust rollers 7 and 7'.

The first folding drum 8 and the second folding drum 8' are identical in construction and function except that the first folding drum 8 and the second folding drum 8' are in mirror-image relationship with each other, and peripheral parts associated with the first folding drum 8 and those associated with the second folding drum 8' are substantially the same. Therefore the parts of the second folding drum 8 and the peripheral parts associated with the second folding drum 8' are denoted by the same reference numerals as those denoting the parts of the first folding drum 8 and the peripheral parts associated with the first folding drum 8, and distinguished by an index "'" from the numerals denoting the parts of the first folding drum 8 and the peripheral parts associated with the first folding drum 8, and only the first folding drum 8 and the peripheral parts associated with the first folding drum 8 will be described and the description of the second folding drum 8' will be omitted, except when necessary.

As shown in FIG. 2, the first folding drum 8 is provided with two longitudinal grooves 10 formed at positions diametrically opposite to each other in the circumference thereof, shafts 11 extended, respectively, within and along the grooves 10, swing grippers 12 for gripping bags mounted, respectively, on the shafts 11, and thrusting and cutting blades 13 provided on the circumference of the first folding drum 8 at positions diametrically opposite to each other.

The swing grippers 12 and the thrusting and cutting blades 13 are arranged alternately and spaced 90° apart from each other.

The thrusting and cutting blades 13 are provided with suction holes in the side surfaces thereof to attract the tube P by suction. The extremity of each thrusting and cutting blade 13 is edged to cut the tube P together with a cutting blade 35 which will be described later.

As shown in FIG. 2, the angular phase difference between the first folding drum 8 and the second folding drum 8' is determined so that the grooves 10 of the first folding drum 8 coincide periodically with the thrusting and cutting blades 13' of the second folding drum 8', and the thrusting and cutting blades 13 of the first folding drum 8 coincide periodically with the grooves 10' of the second folding drum 8' as the folding drums 8 and 8' are rotated synchronously.

Figure 8:
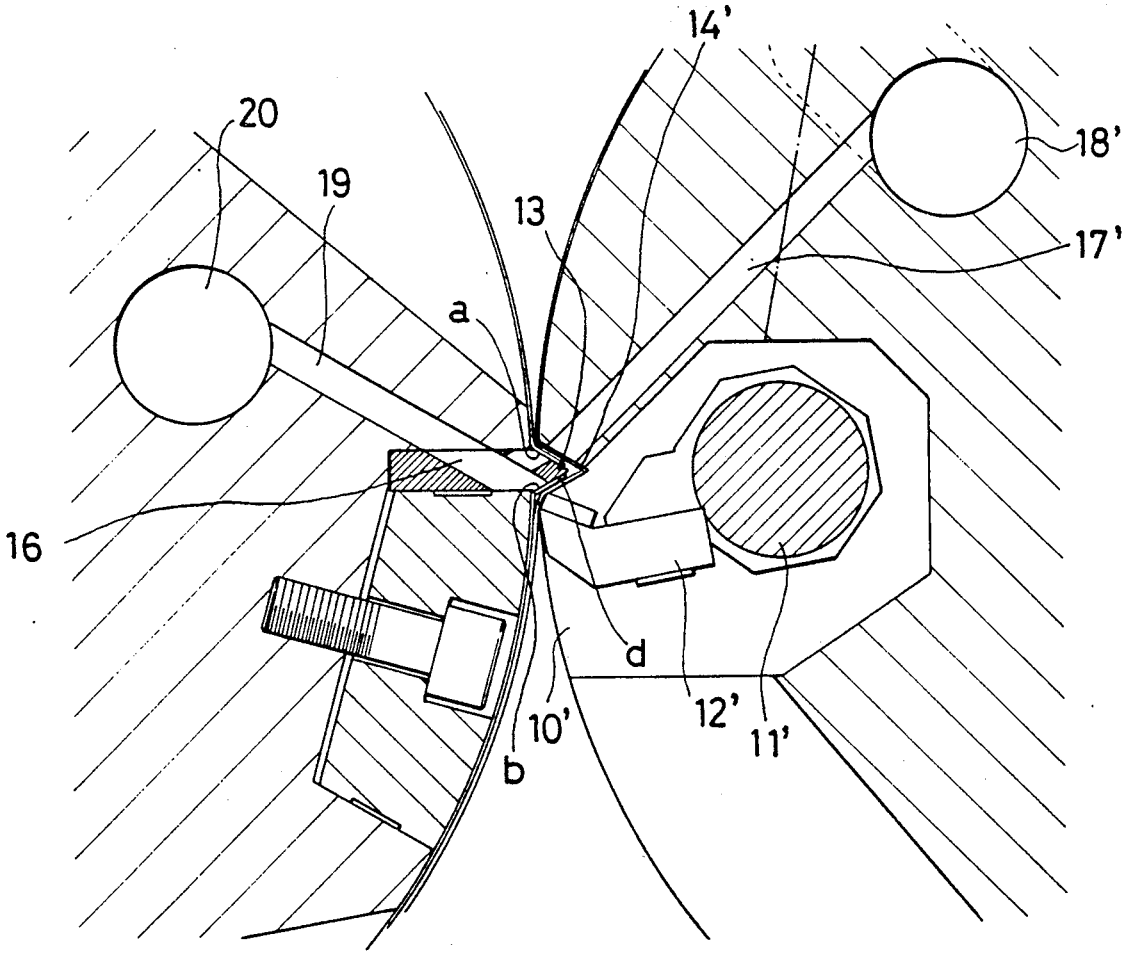
FIGS. 8, 9 and 10 are enlarged sectional views of the folding drums in different stages of operation.

As shown in FIG. 2 and FIG. 8, suction surfaces 14 are formed in the walls of the grooves 10, respectively, opposite to the swing grippers 12. A plurality of suction holes 15 are formed in each of the suction surfaces 14.

As shown in FIG. 2, the thrusting and cutting blades 13 are provided each with suction holes 16 in the opposite side surfaces projecting from the circumference of the first folding drum 8.

The suction holes 15 are connected through passages 17 to longitudinal suction passages 18 formed in the first folding drum 8, while the suction holes 16 are connected through passages 19 to longitudinal suction passages 18 formed in the first folding drum 8.

Referring to FIGS. 3, 4, 5 and 6, an end plate 21-1 (FIG. 5) is attached to the left end of the folding drum 8, and a flow-change valve plate 21 is disposed coaxially with the folding drum 8 in sliding contact with the end plate 21-1. A suction passage 22 and a blowing passage 23 are formed separately in the inner peripheral portion of the flow-change valve plate 21.

Figure 6:
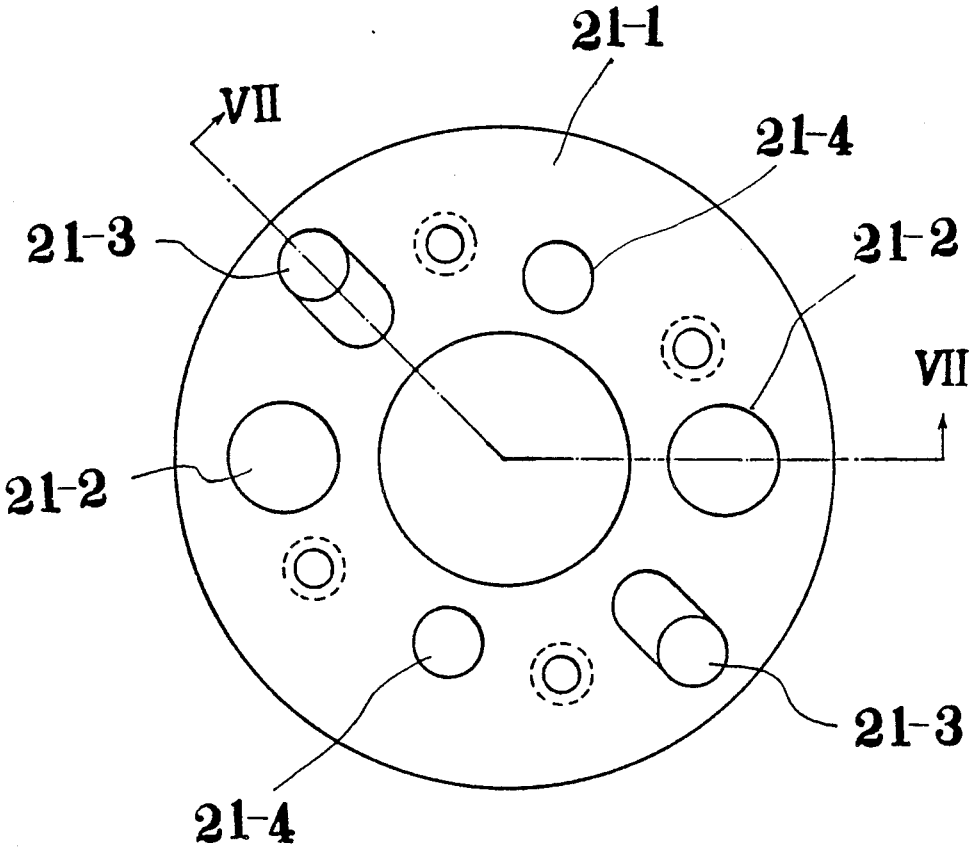
FIG. 6 is an enlarged side elevation of an end plate for the folding drum.
Figure 7:
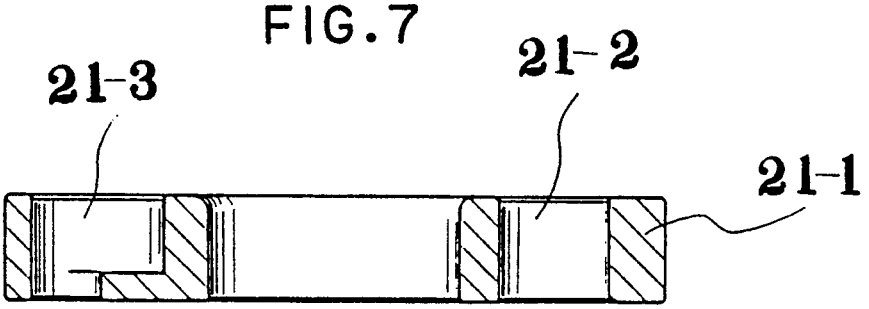
FIG. 7 is a sectional view taken on line III—III in FIG. 6.

As best shown in FIG. 6, the end plate 21-1 is provided with holes 21-2 for receiving the shafts 11, holes 21-3 connecting to the longitudinal suction passages 18, and holes 21-4 connecting to the longitudinal suction passages 20.

The holes 21-3 connecting to the longitudinal suction passages 18 are greater than the holes 21-4 connecting to the longitudinal suction passages 20 in sectional area. The longitudinal suction passages 18 for the suction surfaces 15 are greater than the longitudinal suction passages 20 for the thrusting and cutting blades 13 in sectional area.

Figure 3:
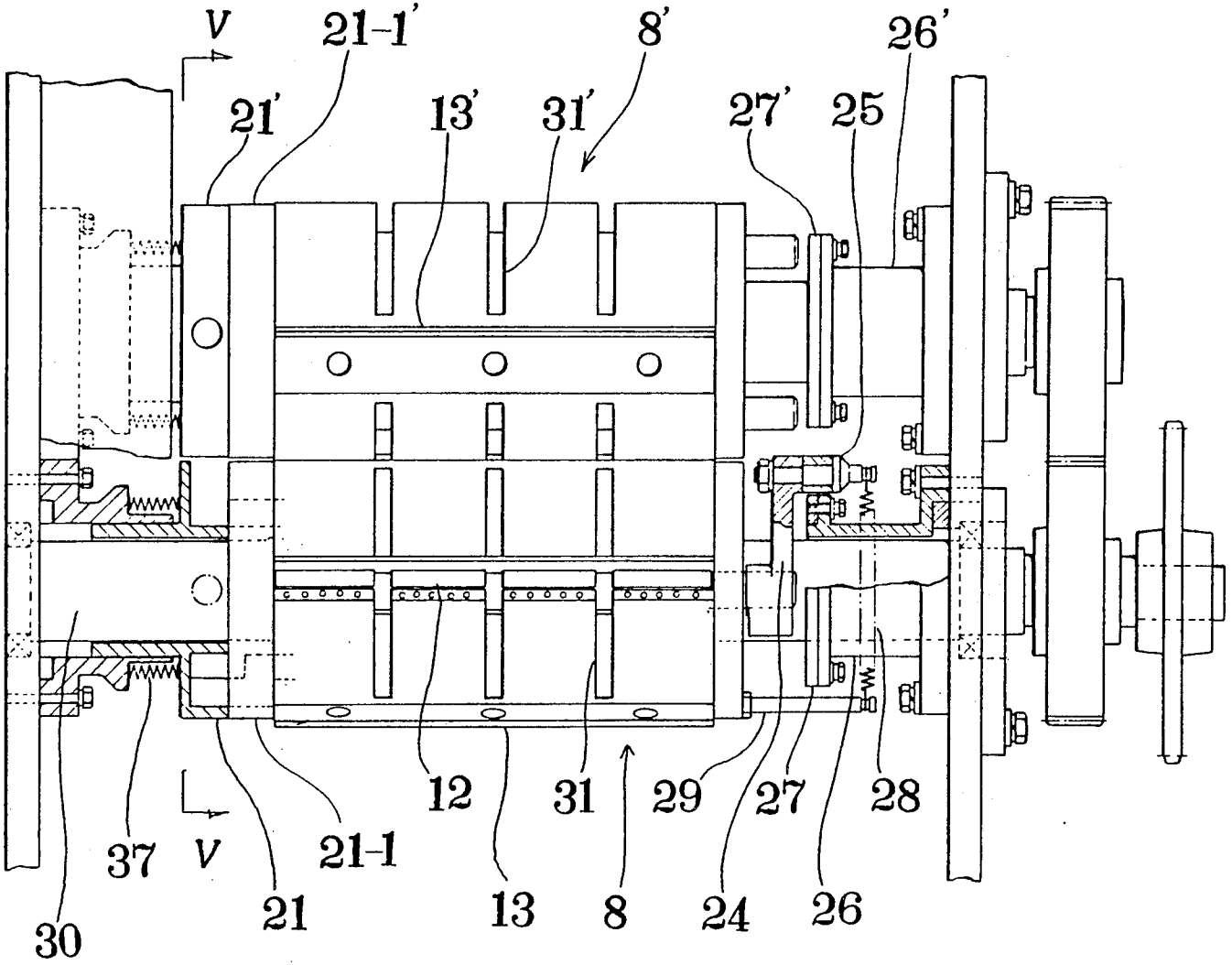
FIG. 3 is a plan View taken on line I—I FIG. 2.

Referring to FIG. 3, an actuating lever 24 is disposed near the right end of the shafts 11 and 11' of the first folding drum 8. A cam follower 25 is supported rotatably on the extremity of the actuating lever 24 so as to roll along a cam 27 mounted on a right-hand support shaft 26 supporting the first folding drum 8.

An extension spring 28 has one end fastened to the actuating lever 24 and the other end fastened to a pin 29 fixed to the first folding drum 8. Circumferential grooves 31 are formed in the circumference of the folding drum 8 to receive pressing arms 32 ( refer to FIG. 2 and FIG. 10A) which swing up and down in synchronism with the rotation of the first folding drum 8.

Indicated at 30 and 30' are left hand support shafts for supporting the folding drums 8 and 8'.

Referring again to FIG. 2 and FIG. 10A, the base end of each of the pressing arm 32 is fixed to a shaft 33. The free end of the pressing arm 32 is bent upward.

A conveyor belt 34 is extended under the folding drums 8 and 8'. A pair of guide plates 34-1 having a shape resembling the letter L is disposed between the folding drums 8 and 8' and the conveyor belt 34 to guide folded bags released from the folding drums 8 and 8' to the conveyor belt 34.

Delivery rollers 34-4 are disposed above the rear portions of the guide plates 334-1.

Figure 10:
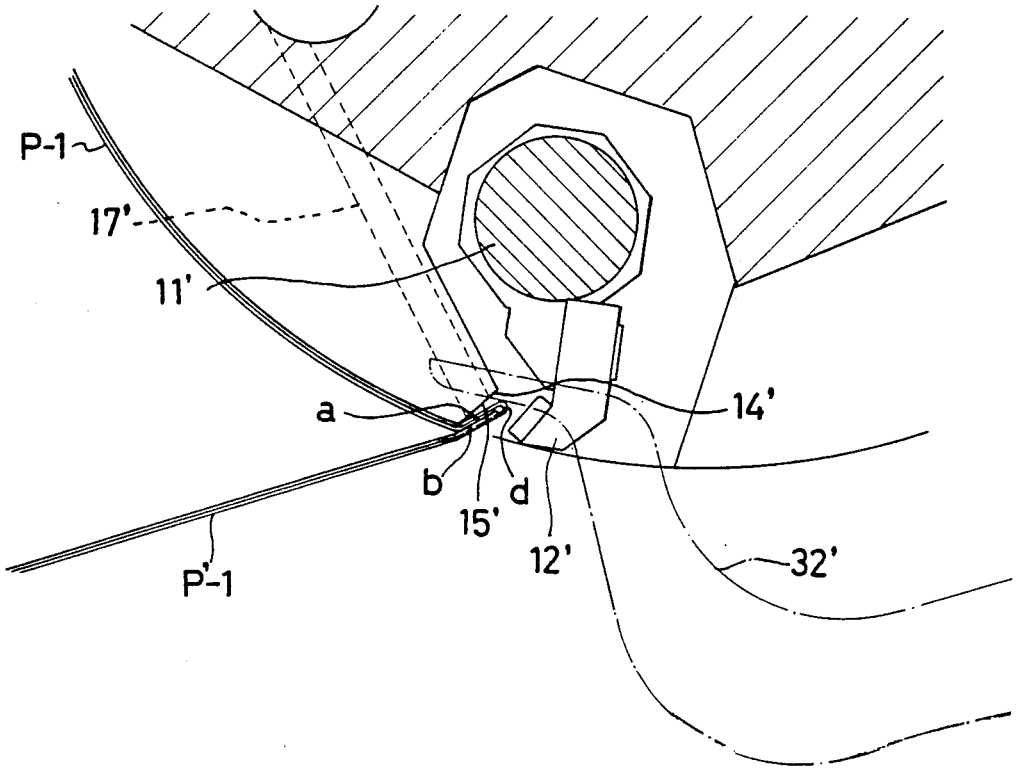
Figure 10A:
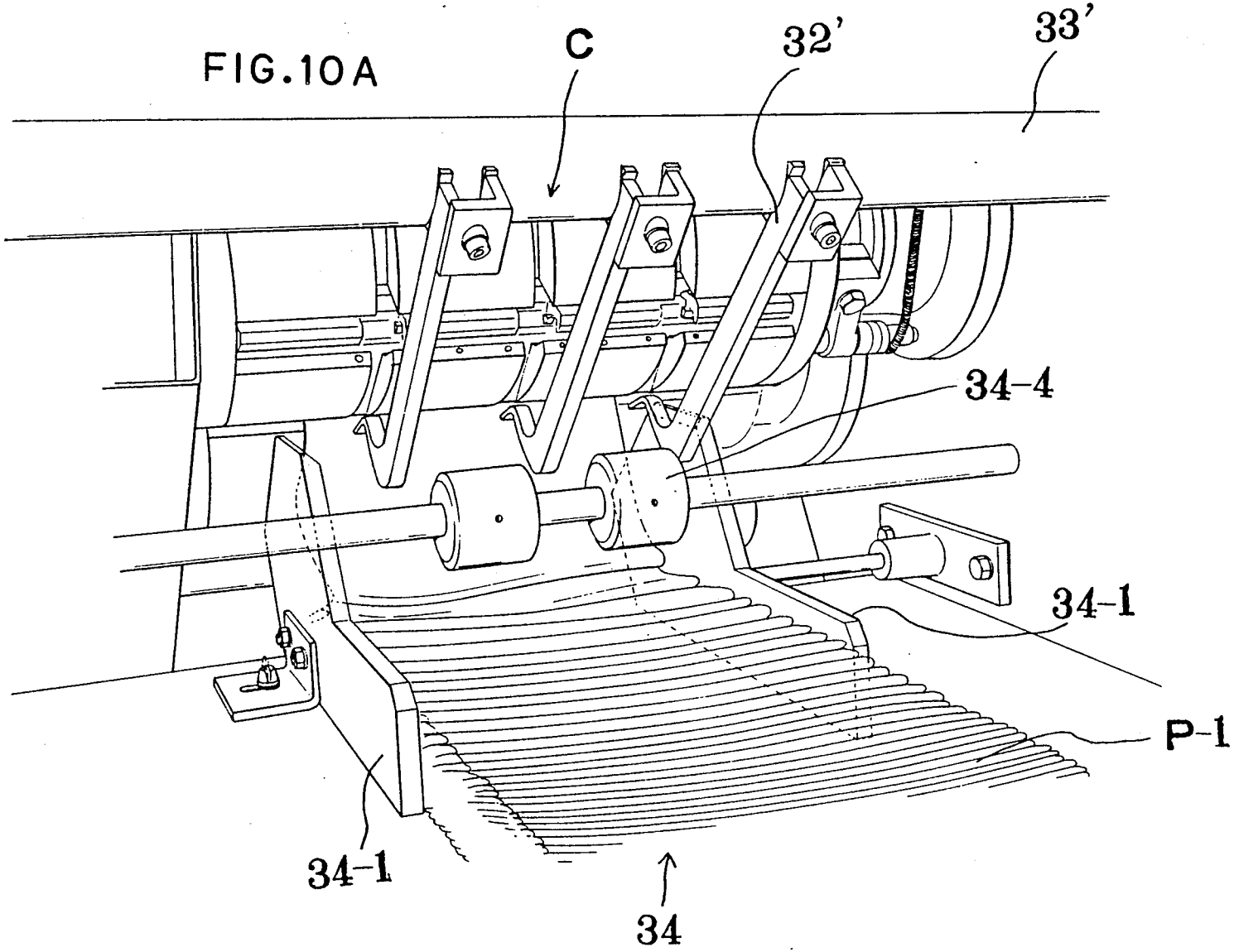
FIG. 10A is a perspective view of pressing arms, guide plates and the conveyor belt for receiving folded bags.
Figure 11A:
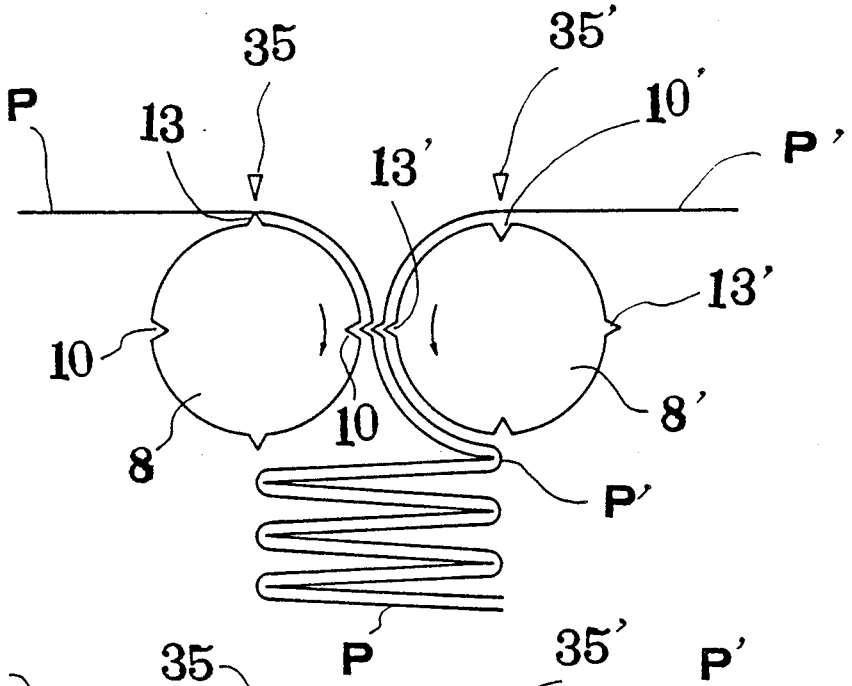
FIGS. 11(*a*) to (*f*) are illustrations for assistance in explaining sequential stages of bag folding operation.
Figure 11B:
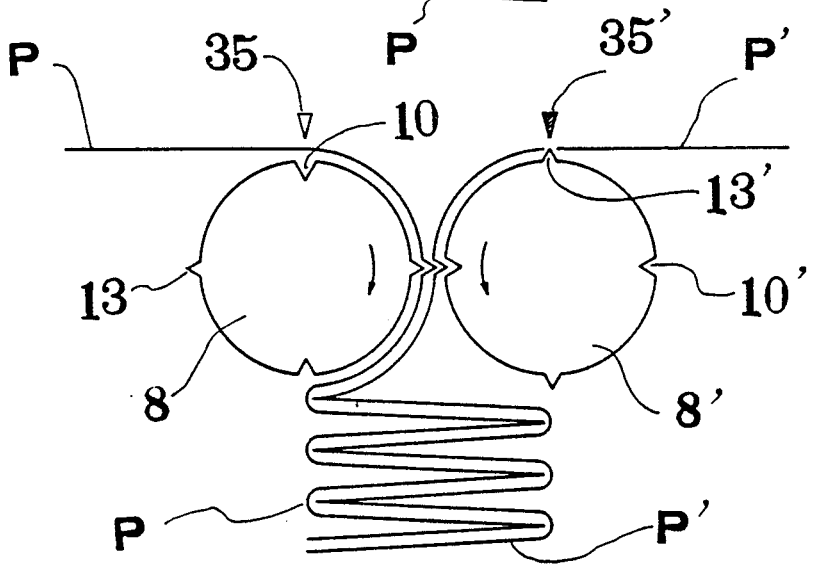
Figure 11C:
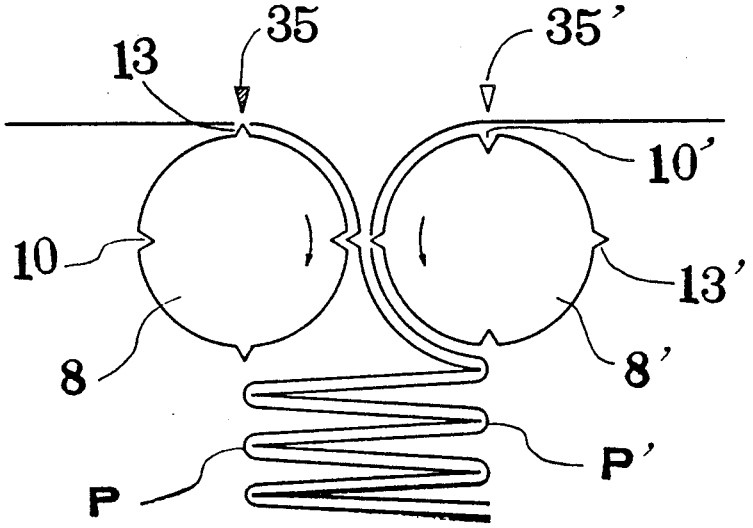
Figure 11D:
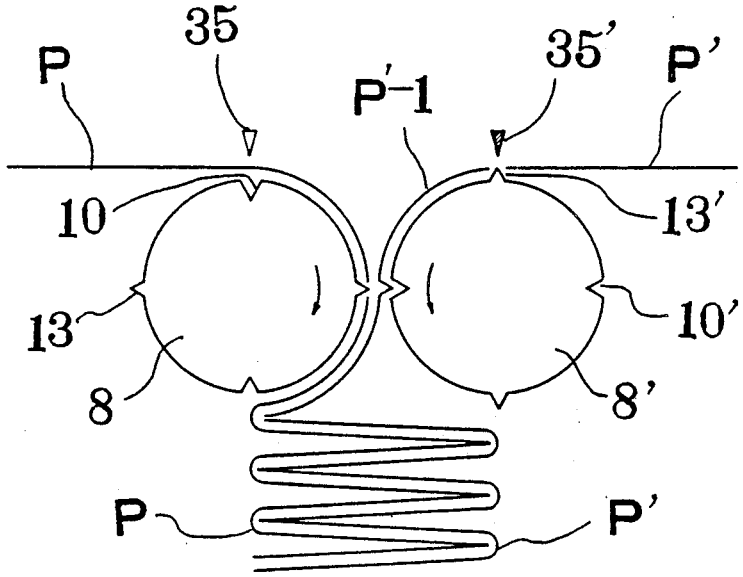
Figure 11E:
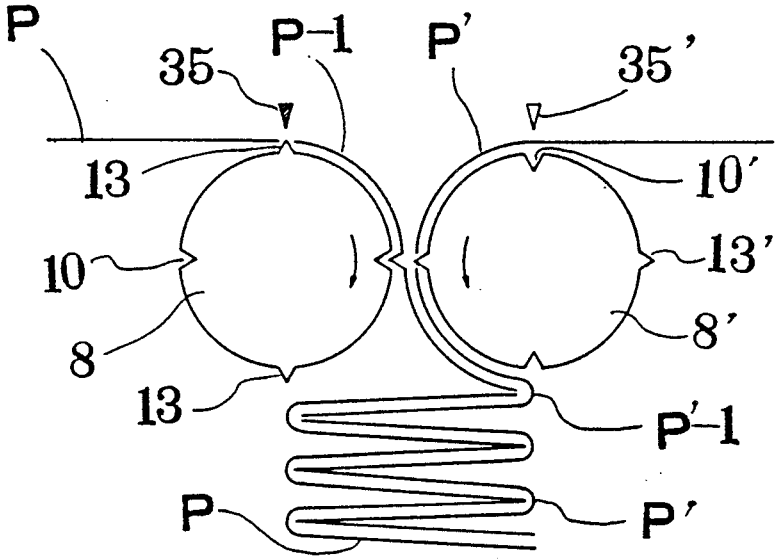
Figure 11F:
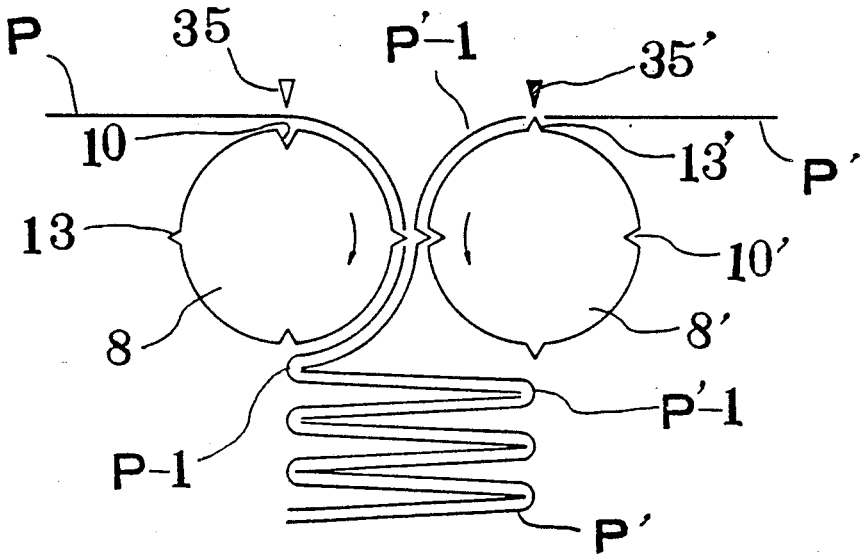

Due to such construction, as shown in FIG. 10A folded bags P-1, P'-1 delivered from the folding drums 8 and 8' to the space 34-1 between the guide plates 34-1 are conveyed backward along the guide plates 34-1 by the conveyor belt 34, while the delivery rollers 34-4 obstruct the backward movement of the upper portions of the folded bags P-1 and P'-1, so that the folded bags P-1 and P'-1 are stacked obliquely.

Referring to other construction of the bag folding portion C shown in FIG. 2, a cutting blade 35 which is actuated by a hydraulic cylinder 35*a* is placed above the first folding drum 8 for tube-cutting operation in cooperation with the thrusting and cutting blades 13.

A longitudinal groove 36 is formed in the circumference of the auxiliary thrust roller 7 at a position diametrically opposite to the thrust blade 9 for preventing the thrusting and cutting blades 13 from injuring the surface of the auxiliary thrust roller 7.

Figure 4:
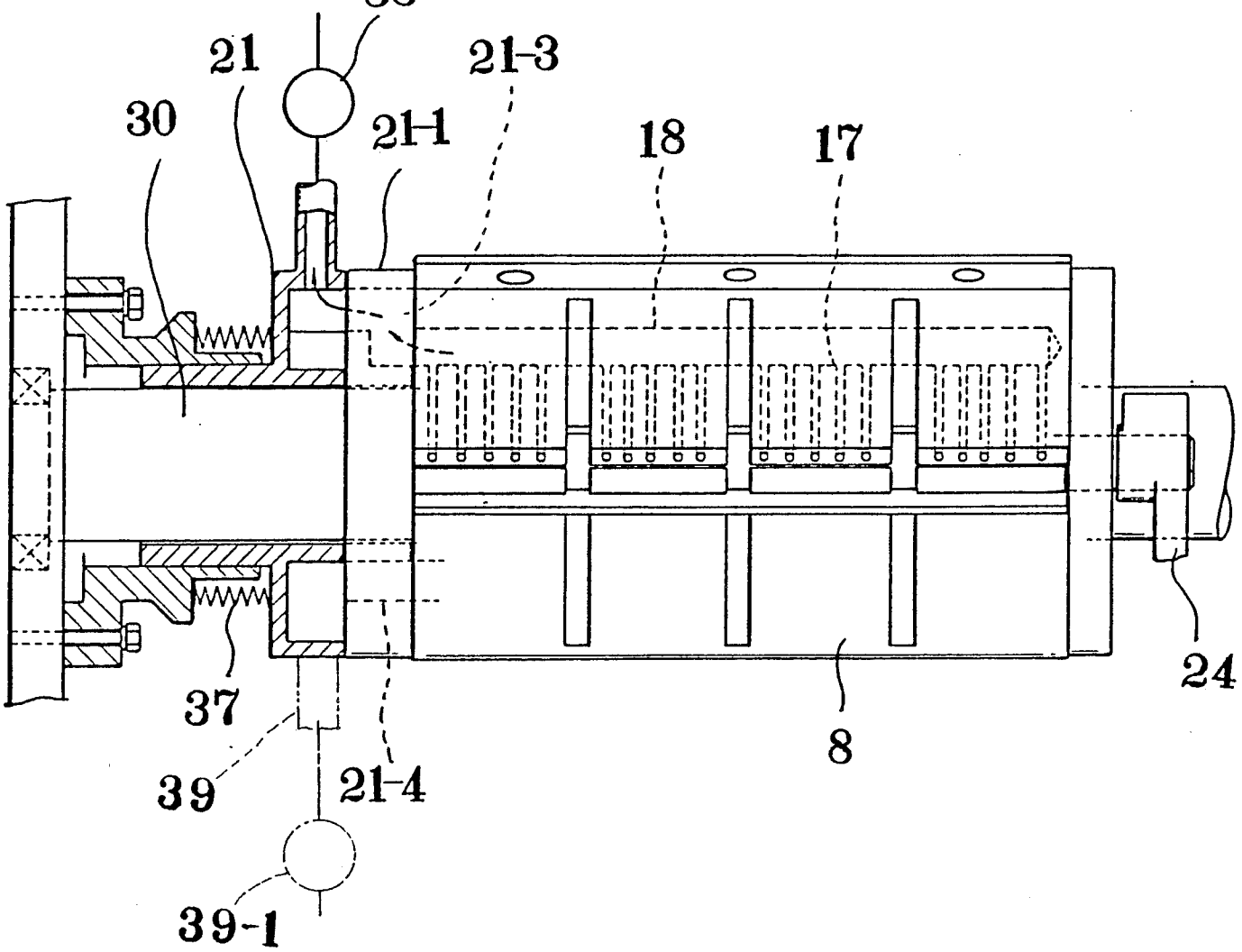
FIG. 4 is a plan view showing the details of a folding drum.
Figure 5:
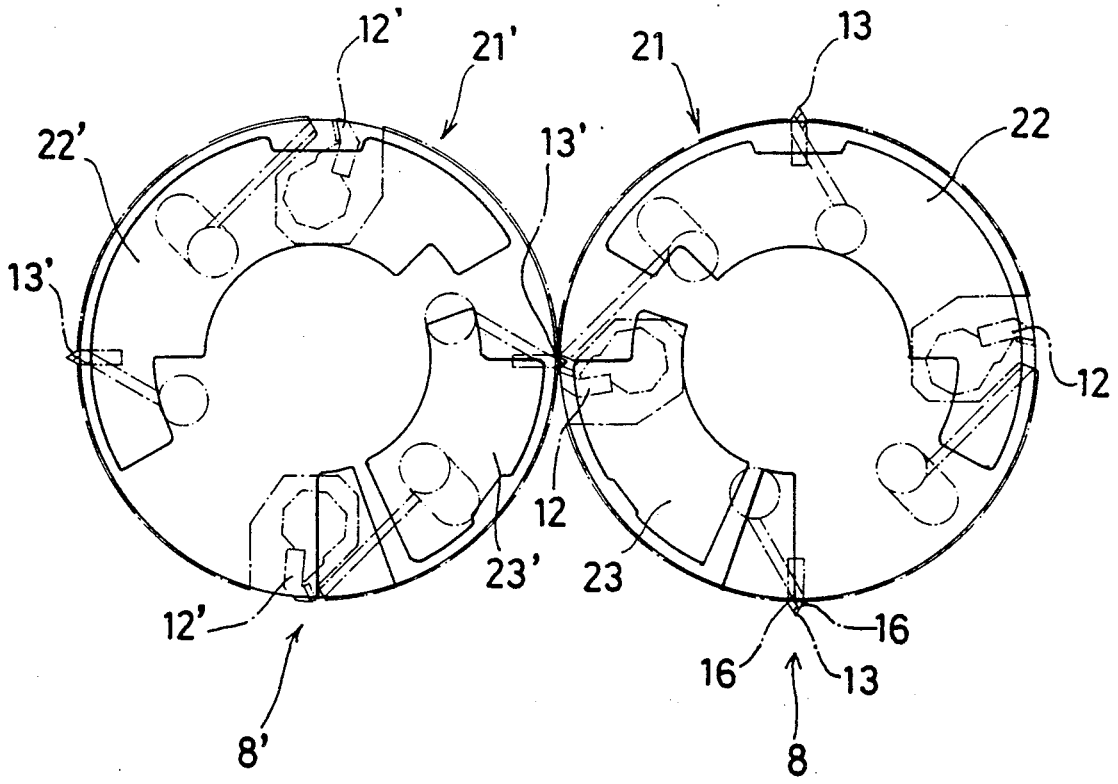
FIG. 5 is a view taken on line II—II in FIG. 3, illustrating flow-change valves.

Referring to FIG. 3 and FIG. 4, a compression spring 37 is mounted on the left support shaft 30 to press the flow-change valve plate 21 against the end plate 21-1 air-tightly.

As shown in FIG. 4, a vacuum pump 38 is connected to the vacuum passages 22 and 22' of the flow change valve plates 21 and 21'. A pipe 39 is connected to the blowing passages 23 and 23' of the flow-change valve plates 21 and 21' to supply compressed air into the blowing passages 23 and 23'.

The manner in which the bags P-1 and P-2 are folded is described hereinafter in conJunction with attached drawings.

Referring to FIG. 1, the tubes P and P' unwound from the tube rolls 1 and 1' supported, respectively, on the support shafts 2 and 2' travel via the tension rollers 3 and 3', which apply an appropriate tension to the tubes P and P', to the sealing sections B and B'.

Sealed portions 5 and 5' (refer to FIG. 12) are formed across the tubes P and P' at regular intervals by the cooperative sealing action of the feed rollers 6 and 6' and the heaters 4 and 4'.

Then, the tubes P and P' having sealed portions 5 and 5' are fed through the thrust rollers 7 and 7' to the folding drums 8 and 8', respectively.

The first folding drum 8 and the associated parts, and the second folding drum 8' and the associated parts are the same in function, hence only the operation of the first folding drum 8 and the associated parts will be described and the description of the operation of the second folding drum 8' and the associated parts will be omitted except when necessary.

Referring to FIG. 2, the thrust blade 9 of the auxiliary thrust roller 7 thrusts the tube P into the groove 10 of the folding drum 8. Then, air is sucked through the suction holes 15 formed in the suction surface 14 to hold the tube P by suction in the groove 10.

Upon the arrival of the thrusting and cutting blade 13 at an upper position, the tube P is cut into separate bags P-1 by the cooperative action of the thrusting and cutting blade 13 and the cutting blade 35, and the edges a and b of the bags P-1 are held closely on the thrusting and cutting blade 13 by the attraction of air sucked through the suction holes 16 formed in the opposite sides of the thrusting and cutting blade 13 as shown in FIG. 2 and FIG. 8.

As the folding drum 8 rotates further, the thrusting and cutting blade 13 of the first folding drum 8 is brought together with the bag P-1 into engagement with the groove 10' of the second folding drum 8' holding a bag P'-1 on the suction surface 14' by suction as shown in FIG. 2.

Upon the engagement of the thrusting and cutting blade 13 of the first folding drum 8 with the groove 10' of the second folding drum 8', the shaft 11' of the second folding drum 8' is turned clockwise by the cam 27' to engage the swing gripper 12' and the thrusting and cutting blade 13 as shown in FIG. 8. Consequently, the trailing edge b of the preceding bag P-1 and the leading edge a of the succeeding bag P-1 are placed in the folded middle portion d of the bag P'-1 in the groove 10' of the second folding drum 8' as shown in FIG. 8.

Figure 9:
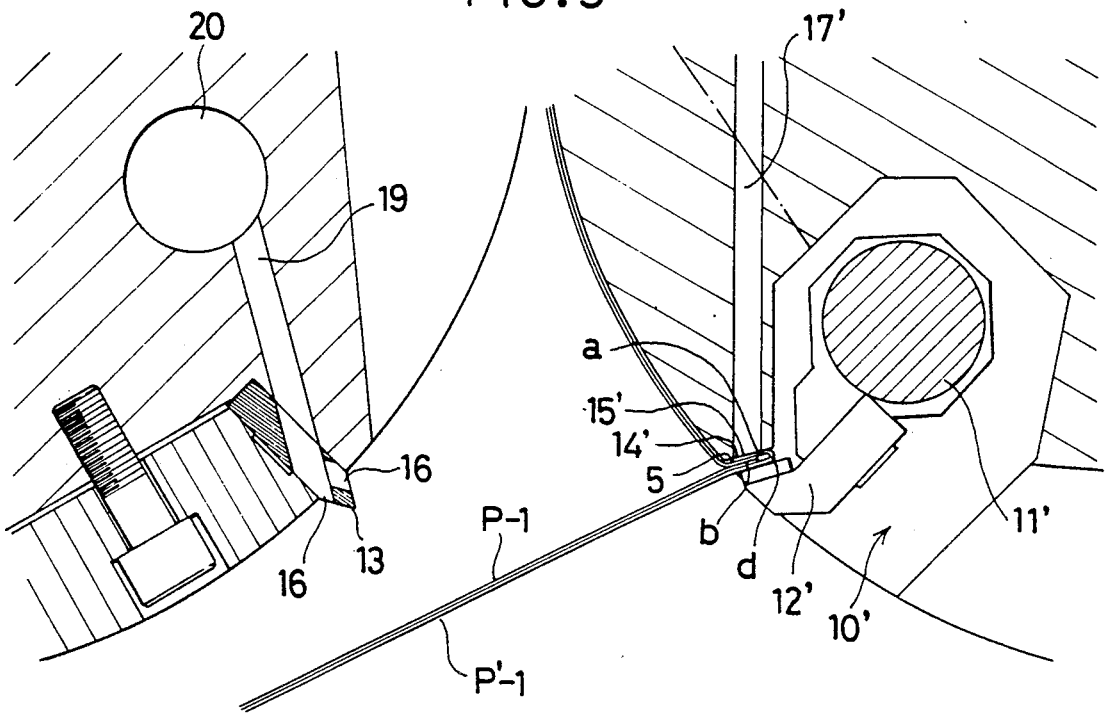

Referring to FIG. 9, as the folding drums 8 and 8' rotate synchronously, the thrusting and cutting blade 13 of the first folding drum 8 leaves the groove 10' of the second folding drum 8' and, at the same time, the swing gripper 12' of the second folding drum 8' grips the folded middle portion d of the bag P'-1 with the edges a and b of the bags P-1 caught in the folded middle portion d of the bag P'-1, and the swing gripper 12' of the second folding drum 8' moves to a lower position gripping together the edges a and b of the bags P-1 and the folded middle portion d of the bag P'-1.

Then, as shown in FIG. 10, the swing gripper 12' swings counterclockwise to release the folded middle portion d of the bag P'-1 together with the edges a and b of the bas P-1 and, at the same time, the extremities of the pressing arms 32' engage the folded middle portion d of the bag P'-1 to press down the bag P'-1 and the bag P'-1 along the guide plates 34-1 onto the conveyor belt 34.

FIGS. 11 (*a*) to (*f*) illustrate sequential stages of the bag folding operation of the folding drums 8 and 8'.

In the initial stage shown in FIG. 11(*a*), a pair of tubes P and P' are fed to the pair of folding drums 8 and 8' and folded in the manner as described above in a zigzag manner provided that the thrusting and cutting blade 13,13' and the cutting blade 35,35' are not actuated so that tubes P and P' are folded continuously in a zigzag manner without being cut into bags P-1 and P'-1.

In a second stage shown in FIG. 11(*b*), the pair of folding drums 8 and 8' are rotated 90° in opposite direction to each other to take a position where the trailing edge of the tube P' on the folding drum 8' is cut by the cooperative operation of the thrusting and cutting blade 13' and the cutting blade 35'.

In a third stage shown in FIG. 11(*c*), the pair of folding drums 8 and 8' are further rotated 90° in opposite direction with each other to take a position where the trailing edge of the tube P is cut by the cooperative operation of the thrusting and cutting blade 13 and the cutting blade 35, while the trailing edge of the cut tube P' and the leading edge of the succeeding tube P' are thrusted into the bent portion of the cut tube P.

In a fourth stage shown in FIG. 11(*d*), the pair of folding drums 8 and 8' are further rotated 90° in opposite direction to each other to take a position where the trailing edge of the succeeding tube P' is cut to form a bag P'-1 and the trailing edge of the cut tube P and the leading edge of the succeeding tube P are thrusted into the middle portion of the bag P'-1 and the bent portion of the cut tube P is lowered while holding the trailing edge of the cut tube P' and the leading edge of the bag P'-1 being thrusted into the bent portion of the cut tube P.

In the fifth stage shown in FIG. 11(*e*), the pair of folding drums 8 and 8' are further rotated 90° in opposite direction to each other to take a position where the trailing edge of the succeeding tube P is cut to form a bag P-1 and the trailing edge of the bag P'-1 and the leading end of the succeeding tube P' are thrusted into the middle portion of the bag P and the middle portion of the bag P'-1 is lowered while holding the trailing end of the cut tube P and the leading end of the bag P-1 being thrusted in the middle portion of the bag P'-1.

In a sixth stage shown in FIG. 11(*f*), the pair of folding drums 8 and 8' are further rotated 90° in opposite direction to each other to take a position where, as in the stage shown in FIG. 11(*d*), the trailing edge of the succeeding tube P' is cut to form a bag P'-1 and the trailing edge of the cut tube P and the leading edge of the succeeding tube P are thrusted into the middle portion of the bag P'-1 and the bent portion of the cut tube P is lowered while holding the trailing edge of the cut tube P' and the leading edge of the bag P'-1 being thrusted in the bent portion of the cut tube P.

Figure 13:
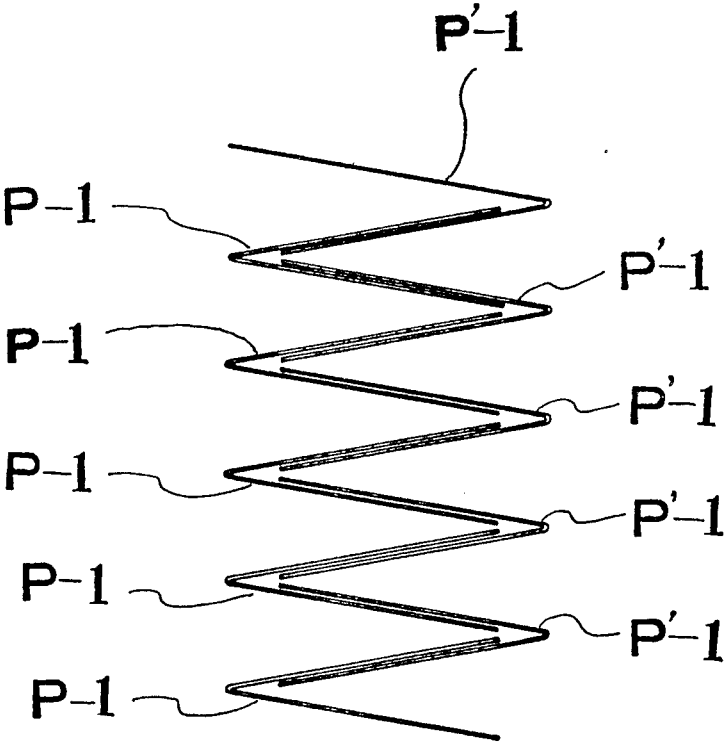
FIG. 13 is a view showing successive folded bags.
Figure 12:
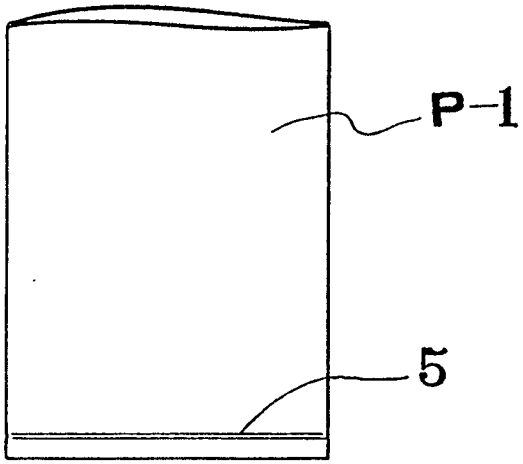
FIG. 12 is a front elevation of a plastic bag.

Thus, the first folding drum 8 and the second folding drum 8' fold bags P-1 and bags P'-1 and release the bag P-1 and P'-1 alternately as shown in FIG. 13, in which the leading half of each of the bags P-1 and the trailing half of each of the bags P'-1 overlap each other, and the trailing half of each of the bags P-1 and the leading half of each of the bags P'-1 overlap each other. FIG. 12 shows a bag P-1 (P'-1) having a lower sealed portion 5.

To recapitulate the above manner of operation, the trailing edge and leading edge of successive bags P-1 (P'-1) formed by sealing and cutting the tube P(P') are held by suction by the thrusting and cutting blade 13 (13') of the first folding drum 8 (the second folding drum 8').

The trailing edge and leading edge of the successive bags P-1 (P'-1) are thrusted together with the middle portion of a bag P'-1 (P-1) carried by the second folding drum 8' (the first folding drum 8) into the groove 10' (10) of the second folding drum 8' (the first folding drum 8) to fold the bag P'-1 (P-1) across the middle portion thereof with the trailing edge and leading edge of the bags P-1 (P'-1) caught in the folded middle portion of the bag P'-1 (P-1).

And then the folded middle portion of the bag P'-1 (P-1), and the trailing edge and leading edge of the successive bags P-1(P'-1) are gripped by the swing grippers 12' (12) of the second folding drum 8' (the first folding drum 8).

Therefore, the bags P-1 and the bags P'-1 alternately folded by the first folding drum 8 and the second folding drum 8' are held securely by the swing grippers 12 and 12' during the bag folding operation. Accordingly, the bags never fall accidentally off the folding drums 8 and 8' during the bag folding operation, and the bags are folded very efficiently and smoothly at a high operating speed.

Furthermore, the pressing arms 32 and 32' provided, respectively, below the first folding drum 8 and the second folding drum 8' swing up and down alternately to press down the folded bags P-1 and P'-1 alternately, so that the folded bags P-1 and P'-1 released alternately from the first folding drum 8 and the second folding drum 8' in an alternate overlapping arrangement are delivered regularly along the guide plates 34-1 to the conveyor 34. Thus, the bag folding machine is able to operate surely for high-speed bag folding operation.

Still further, the auxiliary thrust rollers 7 and 7' for thrusting portions of the tubes P and P' corresponding to the middle portions of bags into the grooves 10 and 10' of the folding drums 8 and 8' ensure the smooth feed of the bags.

Second Embodiment (FIGS. 14 to 19)

A bag folding machine in a second embodiment according to the present invention incorporates improvements in swing grippers, and thrusting and cutting blades provided on a pair of folding drums as shown in FIG. 14 to 19 in which parts like or corresponding to those of the first embodiment are denoted by the sane reference numerals with the prefix "1".

A bag folding section C has a first folding drum 108 and a second folding drum 108' having equal diameters and rotated synchronously in opposite directions. The first folding drum 108 and the second folding drum 108' are identical in construction and function, except that the first folding drum 108 and the second folding drum 108' are in mirror-image relationship with each other, hence the parts of the second folding drum 108' and the peripheral parts associated with the second folding drum 108' are denoted by the same reference numerals as those denoting the parts of the first folding drum 108 and the peripheral parts associated with the first folding drum 108 and distinguished by an index "'" from the numerals denoting the parts of the first folding drum 108, and the peripheral parts associated with the first folding drum 108, only the first folding drum 108. Therefore, the associated parts will be described and the description of the second folding drum 108' will be omitted except when necessary.

Figure 14:
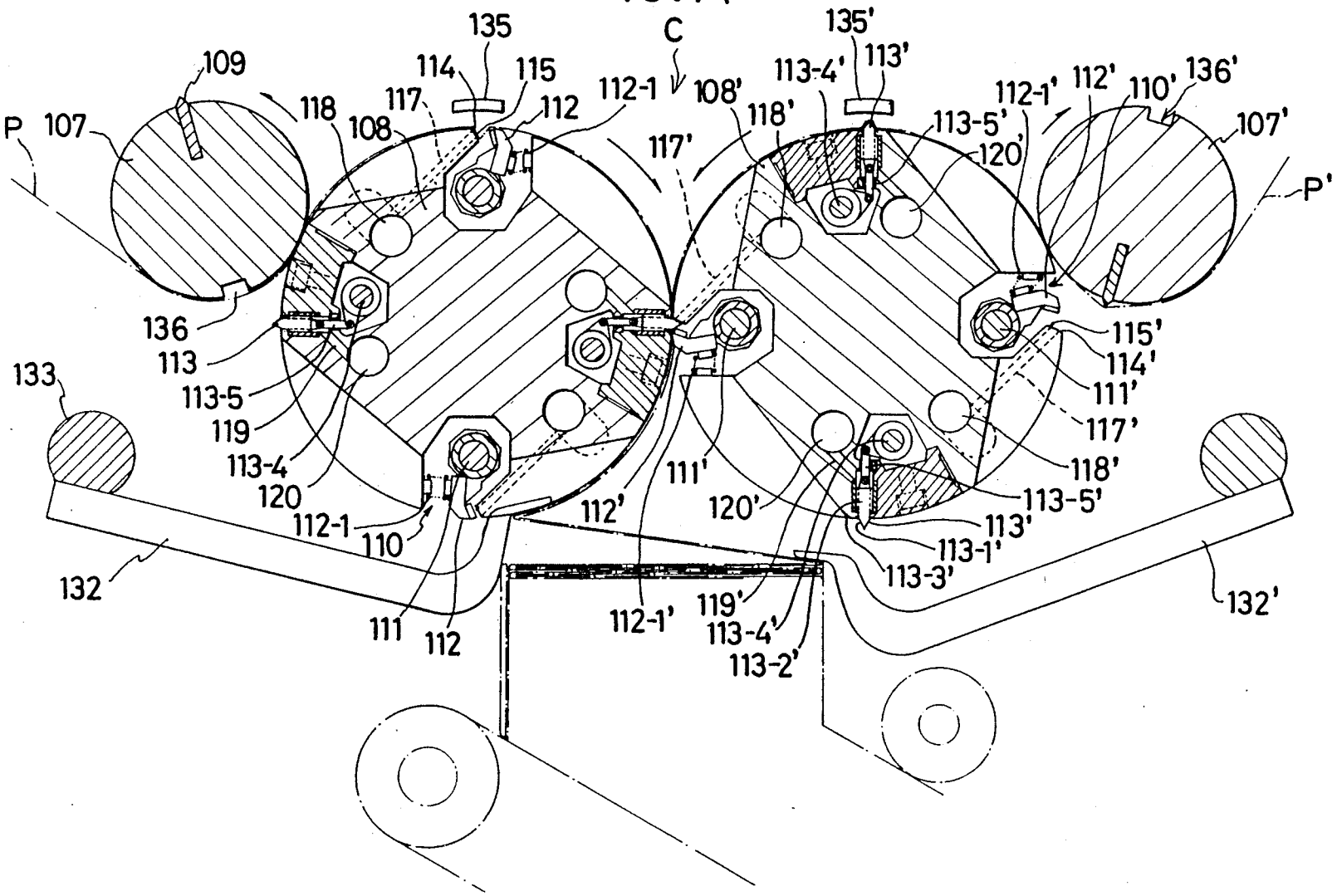
FIG. 14 is an enlarged sectional view of an essential portion of a bag folding machine in a second embodiment according to the present invention.

Referring to FIG. 14, an auxiliary thrust roller 107 associated with the first folding drum 108 is provided with a thrust blade 109. Longitudinal grooves 110 are formed in the circumference of the first folding drum 108 at positions diametrically opposite to each other. Shafts 111 are extended within and along the grooves 110, and swing grippers 112 are mounted on the shafts 111 respectively.

Figure 15:
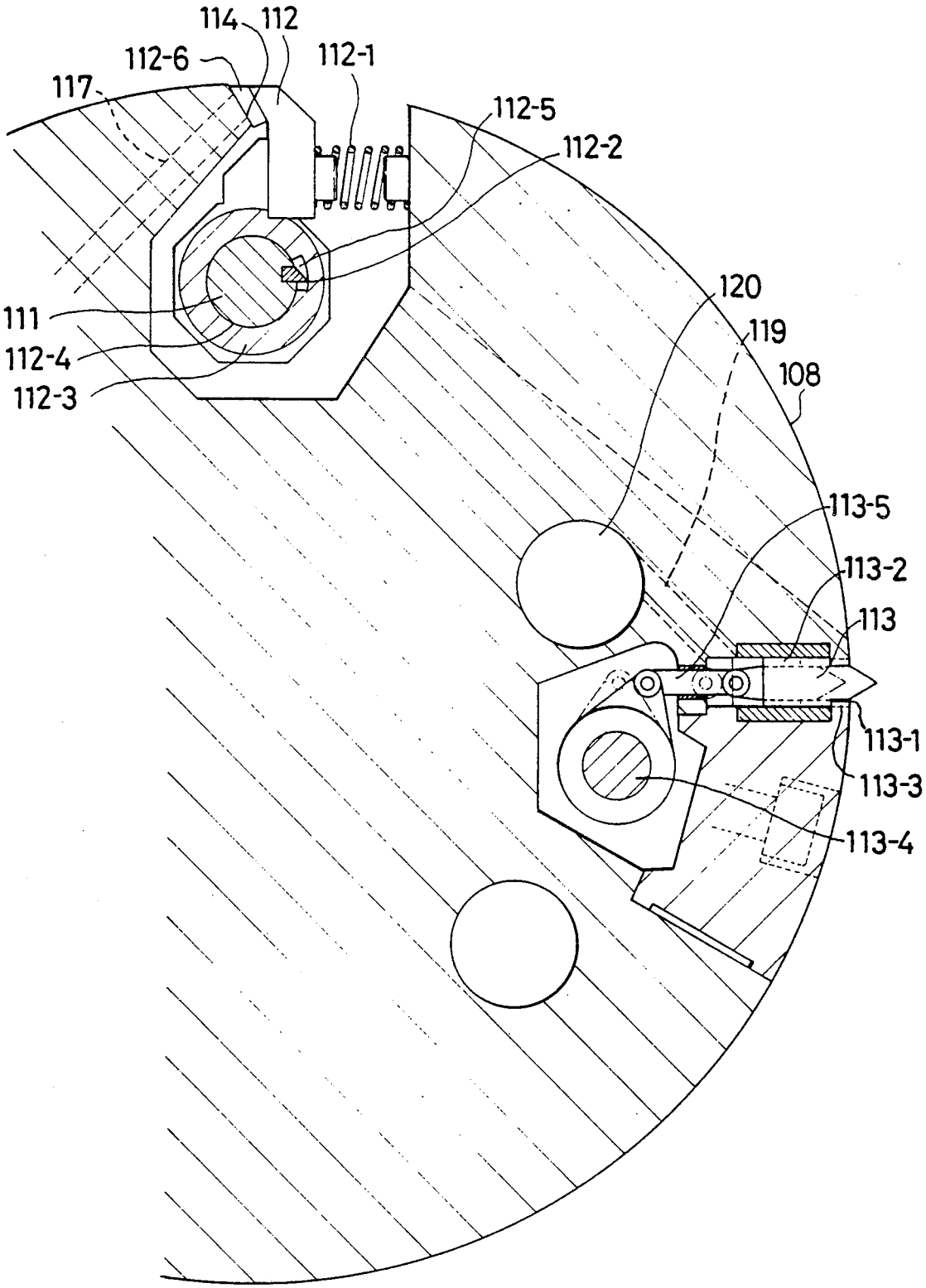
FIG. 15 is an enlarged sectional view of a folding drum employed in the bag folding machine of FIG. 14.

As best shown in FIG. 15, each of the swing grippers 112 is biased in the closing direction, namely, toward a suction surface 114 formed in the side wall of the groove 110, by a spring 112-1. A key 112-2 is seated fixedly in a key seat formed in each of the shafts 111, and a keyway 112-5 having a width greater than that of the key 112-2 is formed in the boss 112-3 of the swing gripper 112 at a position corresponding to the key 112-2 so that the key 112-2 engages the swing gripper 112 only when the shaft 111 is turned in a direction to open the swing gripper 112. When the shaft 111 is turned in the opposite direction, the key 112-2 is separated from the side wall of the keyway 112-5 to allow the swing gripper 112 to be turned toward and to be held in firm contact with the suction surface 114 by the spring 112-1. In FIG. 15, indicated at 112-6 is a rubber pad attached to the extremity of the swing gripper 112.

As shown in FIG. 15, thrusting and cutting blades 113 are disposed in the circumference of the first folding drum 108 at positions diametrically opposite to each other and spaced 90° apart from the swing grippers 112. Each of the thrusting and cutting blades 113 is capable of attracting the tube P to the opposite side surfaces thereof by suction and cutting the tube P with the edge thereof. The phase angle between the first folding drum 108 and the second folding drum 108' is determined so that the grooves 110 and the thrusting and cutting blades 113 of the first folding drum 108 correspond, respectively, to the thrusting and cutting blades 113' and the grooves 100' of the second folding drum 108 '.

Figure 16:
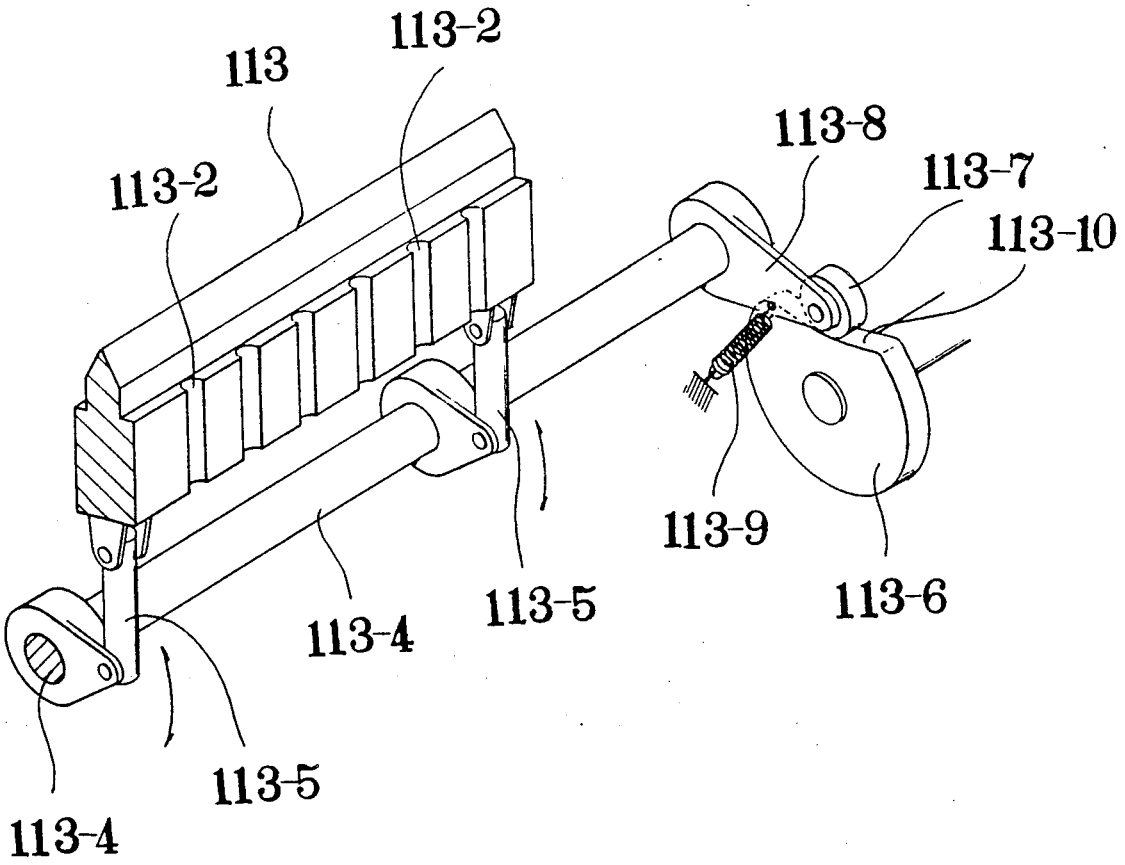
FIG. 16 is a perspective view of a thrusting and cutting blade.

As shown in FIGS. 15 and 16, each of the thrusting and cutting blades 13 is radially slidably received in a longitudinal groove 113-1 formed in the circumference of the first folding drum 108 so as to be projected from and to be retracted into the groove 113-1. Suction passages 113-2 are formed in the side surfaces of each thrusting and cutting blade 113 so as to coincide with suction passages 113-3 formed in the side surfaces of the longitudinal groove 113-1. A crankshaft 113-4 is extended within a longitudinal hole formed below the thrusting and cutting blade 113 to operate the thrusting and cutting blade 113 through links 113-5 for reciprocation. An arm 113-8 is fixed to one end of the crankshaft 113-5 and a cam follower 113-7 is supported rotatably on the free end of the arm 113-8. The arm 113-8 is biased by an extension spring 113-9 so that the cam follower 113-7 is in continuous contact with a rotary cam 113-6. A flat section 113-10 is formed in the cam surface of the cam 113-6.

The tube P having sealed portions at regular intervals is fed through the auxiliary thrust roller 107 to the first folding drum 108. The thrust blade 109 of the auxiliary thrust roller 107 thrusts a portion of the tube P into the groove 110 of the first folding drum 8. Then, the portion of the tube P thrusted into the groove 110 is attracted to the suction surface 114 by air sucked through suction holes 115 formed in the suction surface 114 and thus held in the groove 110. When the thrusting and cutting blade 113 reaches an upper position as the first folding drum 8 rotates, the tube P is cut into successive separate bags P-1 by the cooperative cutting action of the thrusting and cutting blade 113 and a cutting blade 135 disposed at a position corresponding to the upper position. The trailing edge b of the preceding bag P-1 and the leading edge a of the succeeding bag P-1 are attracted closely, respectively, to the side surfaces of the thrusting and cutting blade 113 by air sucked through the suction passages 113-2 formed in the side surfaces of the thrusting and cutting blade 113.

Figure 17:
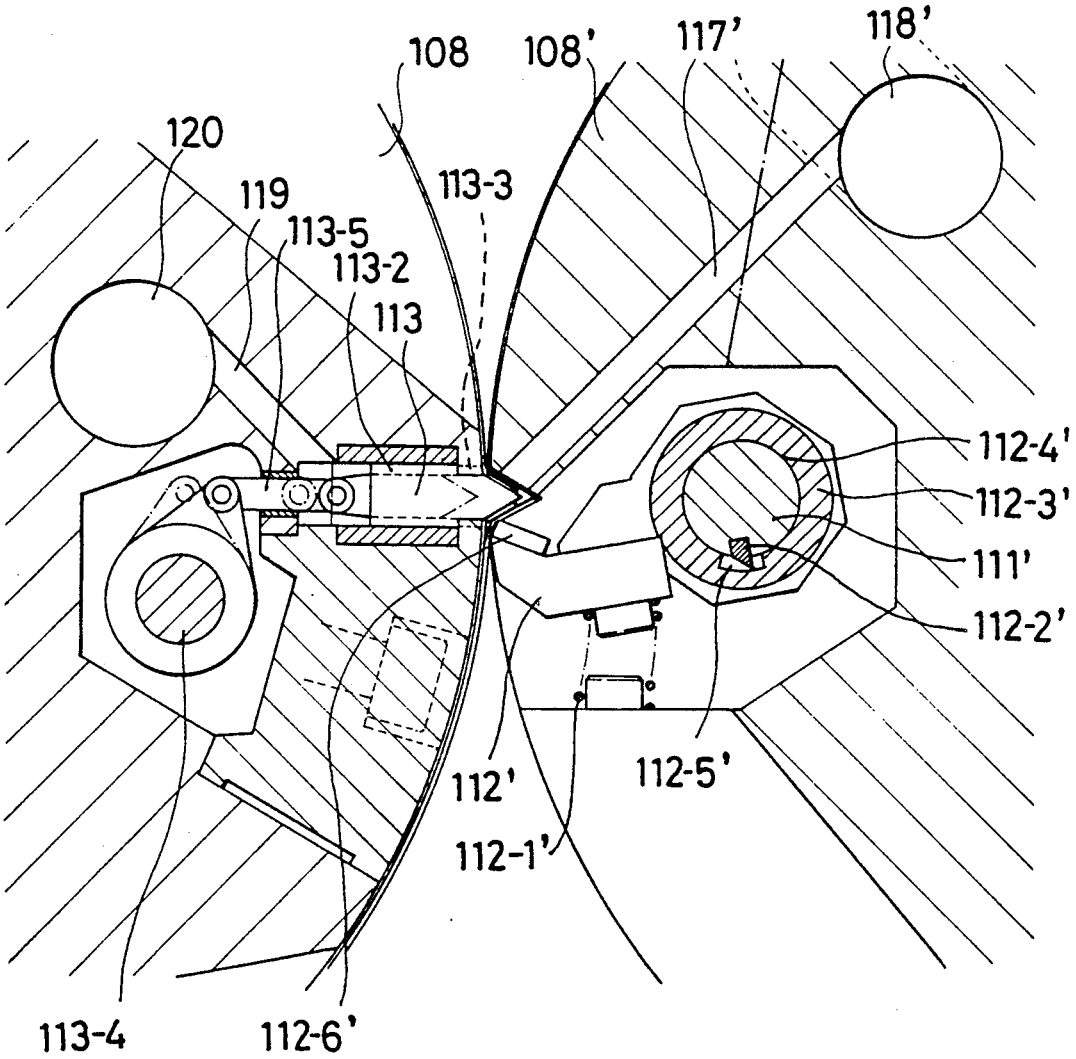
FIGS. 17, 18 and 19 are enlarged sectional views of the folding drums in different stages of bag folding operation.

As the folding drums 108 and 108' rotate further, the thrusting and cutting blade 113 of the first folding drum 108 holding the trailing edge b of the preceding bag P-1 and the leading edge a of the succeeding bag P-1 engages the groove 110' of the folding drum 108' holding the folded middle portion d of a bag P'-1 on the suction surface 114' as shown in FIGS. 14 and 17 and, at the same time, the shaft 111' of the second folding drum 108' is turned clockwise, as viewed in FIG. 17, by a cam 127' to allow the swing gripper 112' to be turned clockwise by the spring 112-1', so that the folded middle portion d of the bag P'-1 and the trailing edge b of the preceding bag P-1 on the first folding drum 108 are gripped between the side surface of the thrusting and cutting blade 113 of the first folding drum 108 and the rubber pad 112-6' of the swing gripper 112' of the second folding drum 108' as shown in FIG. 17.

In this state, the rotation of the folding drums 108 and 108' is interrupted temporarily, and the rotary cam 113-6 is rotated to bring the flat section 113-10 of the rotary cam 113-6 into engagement with the cam follower 113-7 so that the crankshaft 113-4 is turned to retract the thrusting and cutting blade 113 beneath the circumference of the first folding drum 108. Consequently, the swing gripper 112' is turned by the spring 112-1' toward the suction surface 114' to grip the folded middle portion d of the bag P'-1, the trailing edge b of the preceding bag P-1 and the leading edge a of the succeeding bag P-1 between the suction surface 114' and the rubber pad 112-6'.

Figure 18:
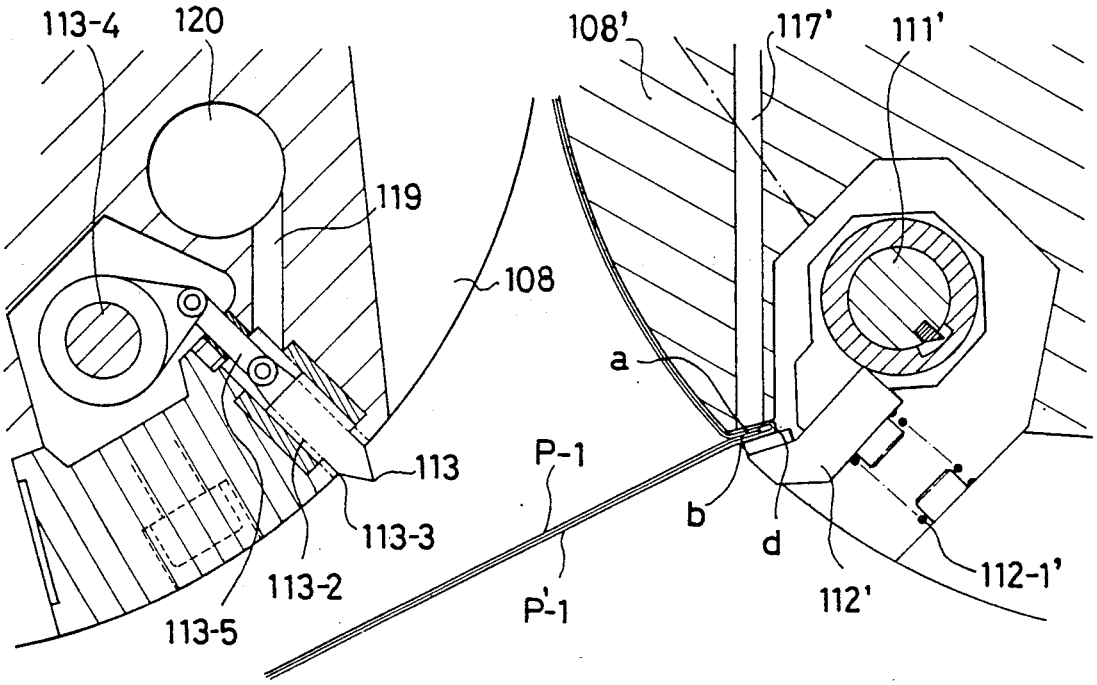

Then, the rotation of the folding drums 108 and 108' is started again. As the folding drums 108 and 108' rotate, the thrusting and cutting blade 113 of the first folding drum 108 leaves the groove 111' of the second folding drum 108' as shown in FIG. 18 while the swing gripper 112' of the second folding drum 108' keeps gripping the folded middle portion d of the bag P'-1 with the trailing edge b of the preceding bag P-1 and the leading edge a of the succeeding bag P-1 held in the folded middle portion d of the bag P'-1.

Figure 19:
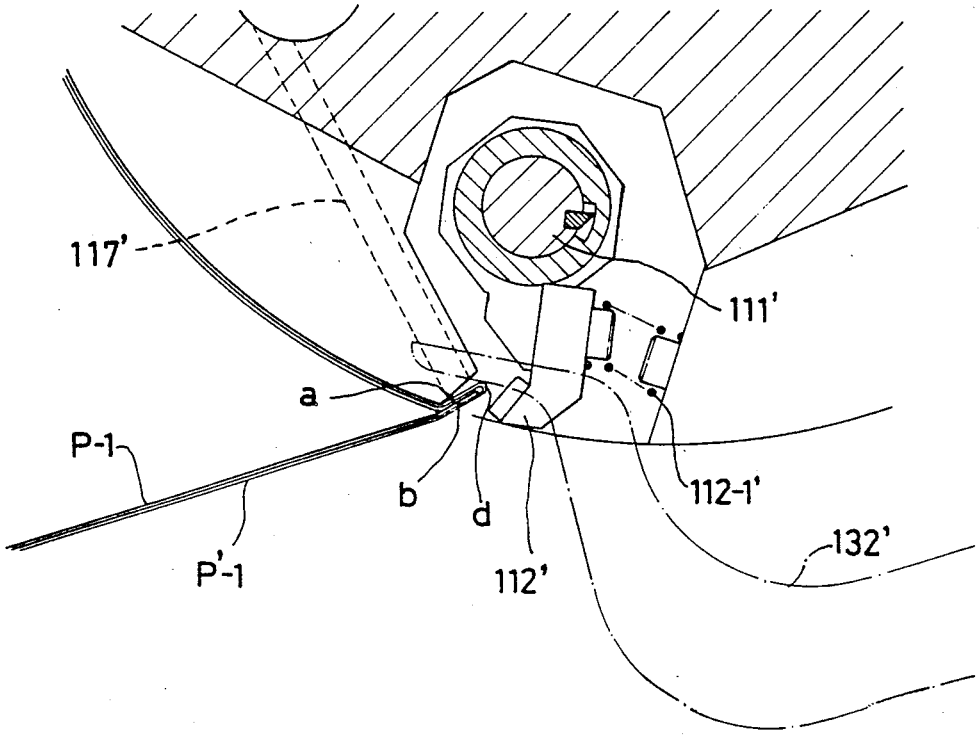

Upon the arrival of the swing gripper 112' at a lower position as shown in FIG. 19, the swing gripper 112' is turned counterclockwise, as viewed in FIG. 19, and, at the same time, the free end of the pressing arm 132' presses the folded middle portion d of the bag P'-1 down to a conveyor belt 134 extended under the folding drums 108 and 108'. Thus, the folding drums 108 and 108' fold bags P-1 and P'-1 alternately.

Thus, in the second embodiment, the thrusting and cutting blades 113 and 113' of the folding drums 108 and 108' are provided with suction passage 113-2 and 113-2' on the side surfaces thereof, and the thrusting and cutting blade 113 (113') is retracted after thrusting the folded middle portion of a bag carried by the second folding drum 108' (the first folding drum 108), the trailing edge of a preceding bag carried by the first folding drum 108 ( the second folding drum 108') and the leading edge of a succeeding bag carried by the first folding drum 108 (the second folding drum 108') in the groove 110 (110').

Therefore, the trailing edge b of the preceding bag P-1 (P'-1) and the leading edge a of the succeeding bag P-1 (P'-1) are held securely on the side surfaces of the thrusting and cutting blade 113 (113') by air sucked through the suction passages 113-2 (113-2').

Accordingly, the bag folding operation is carried out smoothly and the bags P-1 and P'-1 are folded surely and alternately.

Forming the suction passages 113-2 and 113-2' in the side surfaces of the thrusting and cutting blades 113 and 113' facilitates the fabrication of the thrusting and cutting blades 113 and 113' and reduces the leakage of air in attracting the bags P-1 and P'-1 to the thrusting and cutting blades 113 and 113' by suction, so that the bags P-1 and P'-1 are held securely on the thrusting and cutting blades 113 and 113' during the bag folding operation.

Since the shafts 111 and 111' turn the swing grippers 112 and 112' positively only in turning the swing grippers 112 and 112' in the opening direction and allow the swing grippers 112 and 112' to be turned in the closing direction, namely, toward the suction surfaces 114 and 114', by the springs 112-1 and 112-1', the bags P-1 and P'-1 are held securely on the suction surfaces 114 and 114' by the swing grippers 112 and 112', so that the bags P-1 and P'-1 never fall accidentally off the folding drums 108 and 108' during the bag folding operation and hence the bag folding operation can be smoothly continued.

Since the swing grippers 112 and 112' are turned by the springs in the closing direction, the accurate adjustment of the position of the swing arms 112 and 112' relative to the shafts 111 and 111' is not necessary, which facilitates assembling the swing grippers 112 and 112' and the shafts 111 and 111' and facilitates the maintenance work. Furthermore, the bag folding machine is simple in construction and capable of efficiently operating for folding bags.

Figure 20:
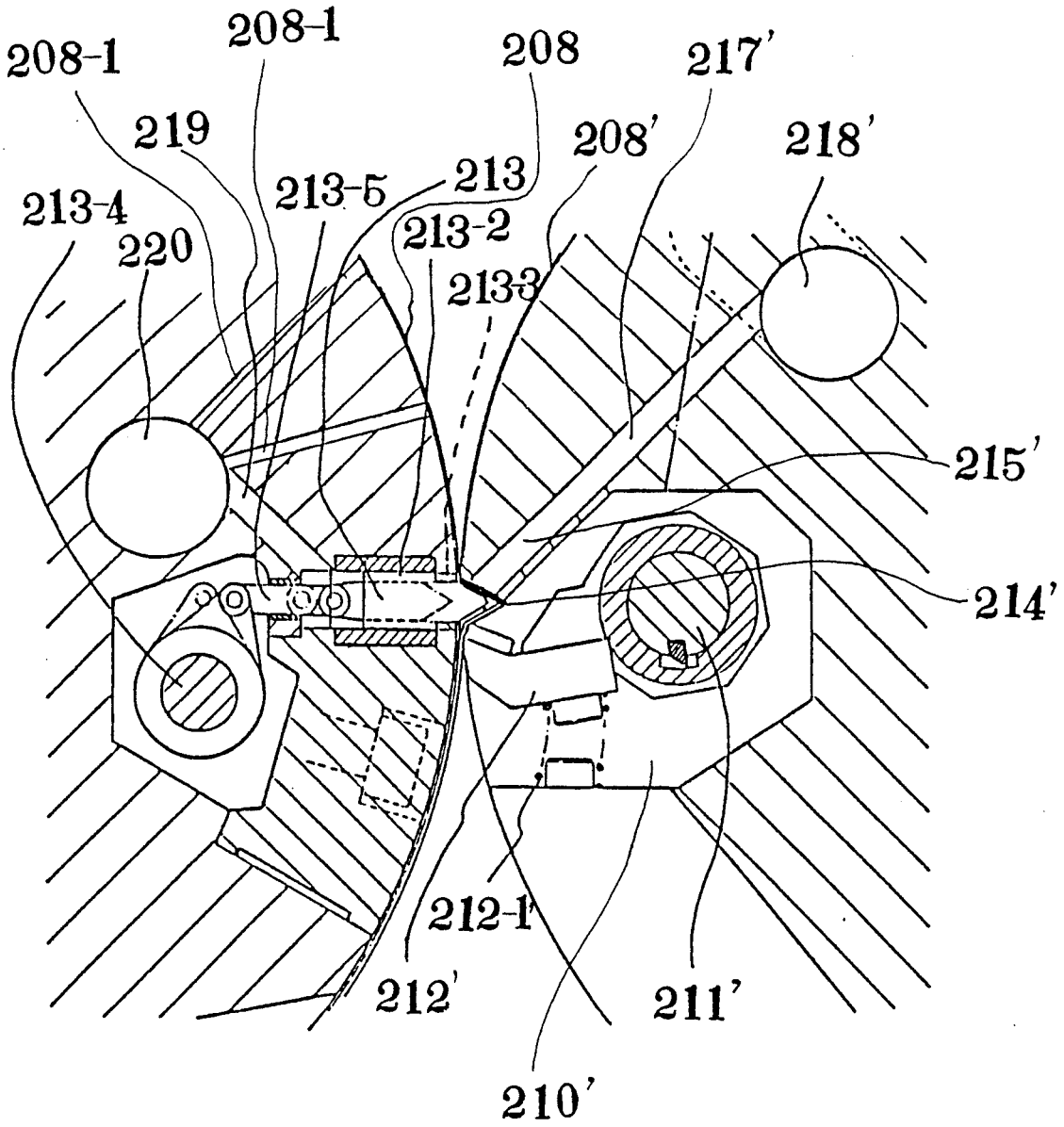
FIGS. 20, 21 and 22 are enlarged sectional views of folding drums employed in a bag folding machine in a third embodiment according to the present invention in different stages of bag folding operation.
Figure 21:
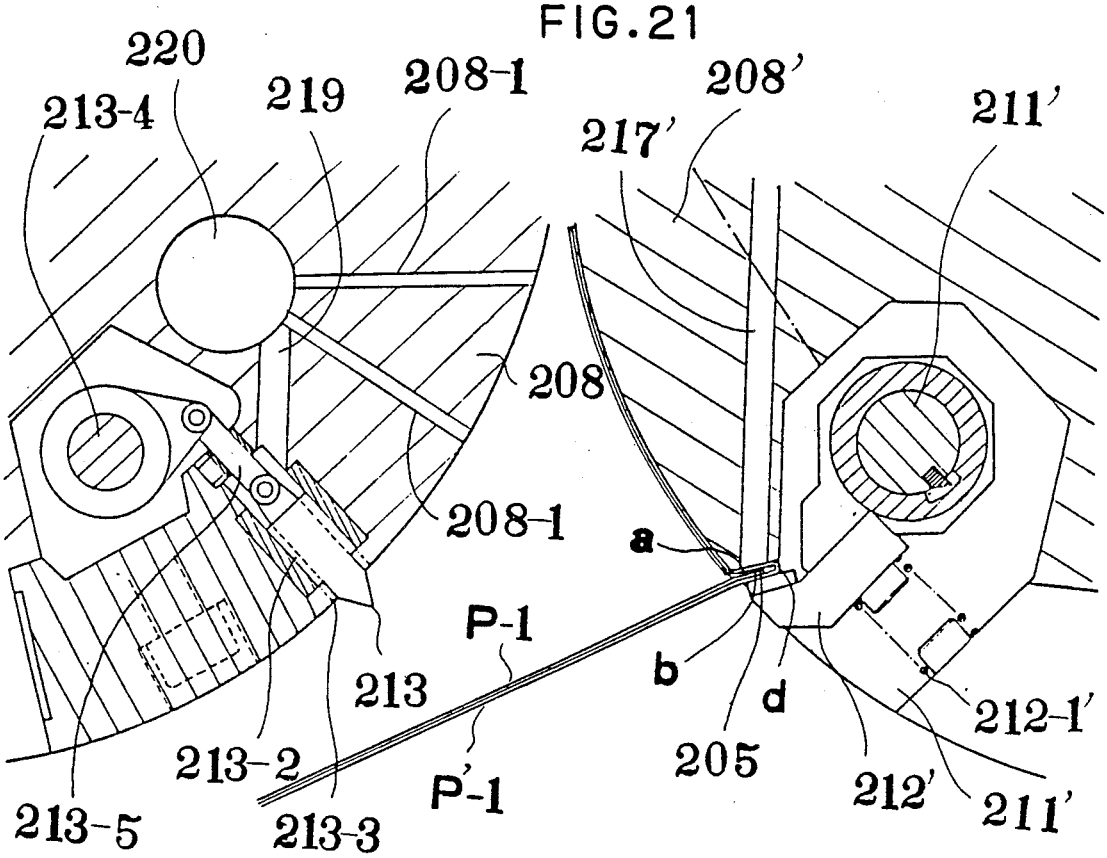
Figure 22:
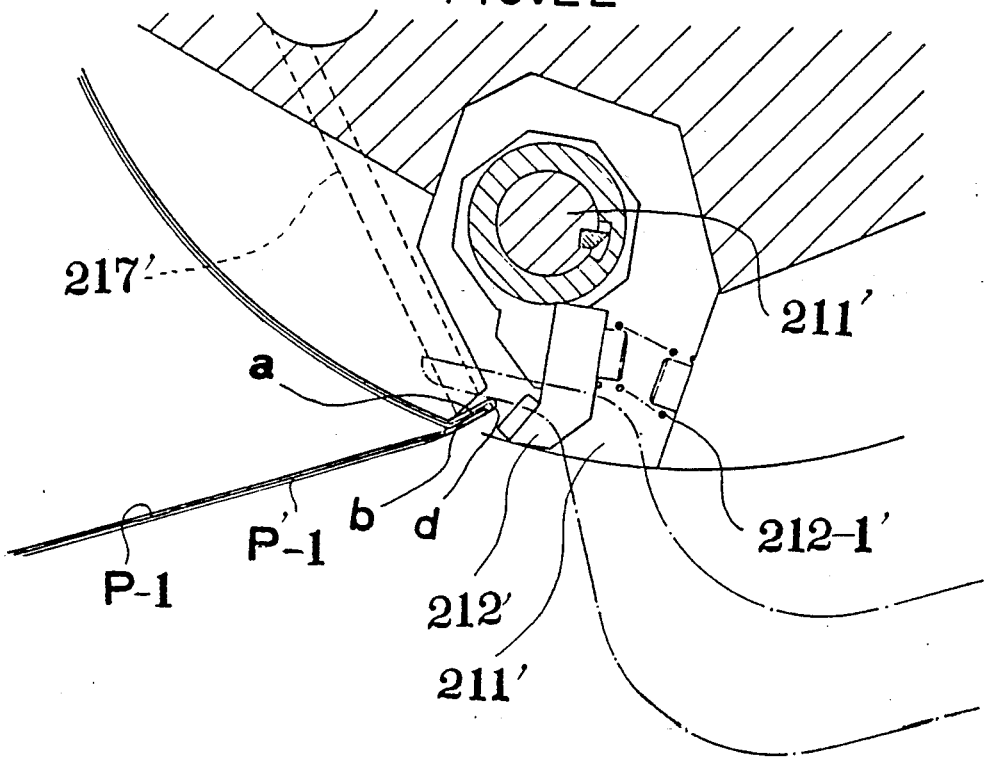

Third Embodiment (FIGS. 20, 21 and 22)

An essential portion of a bag folding machine in a third embodiment according to the present invention is shown in FIGS. 20, 21 and 22, in which parts like or corresponding to those of the first embodiment are denoted by the same reference numerals with the prefix "2".

A bag folding section C has a first folding drum 208 and a second folding drum 208' having equal diameters and rotated synchronously in opposite directions. The first folding drum 208 and the second folding drum 208' are identical in construction and function, except that the first folding drum 208 and the second folding drum 208' are in mirror-image relationship with each other. The first folding drum 208 (the second folding drum 208') is provided with longitudinal grooves 210 (210') formed in the circumference thereof at positions diametrically opposite to each other, thrusting and cutting blades 213 (213') are provided in the circumference thereof at positions diametrically opposite to each other and spaced 90° apart from the longitudinal grooves 210 (210'), and swing grippers 212 (212') are provided in the longitudinal grooves 210 (210').

The angular phase difference between the first folding drum 208 and the second folding drum 208' is determined so that the thrusting and cutting blades 213 of the first folding drum 208 and the thrusting and cutting blades 213' of the second folding drum 208' coincide, respectively, with the grooves 210' of the second folding drum 208' and the grooves 210 of the first folding drum 208 at the point of tangency of the first folding drum 203 and the second folding drum 208'.

Shown in FIGS. 20 and 21 are only a portion of the first folding drum 208 including one of the thrusting and cutting blades 213, and only a portion of the second folding drum 208' including one of the grooves 210' and one of the swing grippers 212'.

Referring to FIG. 20, the swing gripper 212' is mounted on a shaft 211' extended within and along the groove 210' of the second folding drum 208'. Suction holes 215' are formed in a suction surface 214' formed opposite to the gripping surface of the swing gripper 212' in the side wall of the groove 210'. The swing gripper 212' is biased constantly in the closing direction, namely, toward the suction surface 214', by a spring 212-1'.

The suction holes 215' formed in the suction surface 214' communicate with a longitudinal suction passage 218′ formed in the second folding drum 208′ by means of an air passage 217′.

The thrusting and cutting blade 213 is fitted slidably in a longitudinal groove 213-1 formed in the circumference of the first folding drum 208 so as to be proJected from and to be retracted beneath the circumference of the first folding drum 208. Suction grooves 213-2 are formed in the side surfaces of the thrusting and cutting blade 213 so as to coincide, respectively, with suction passages 213-3 formed in the side surfaces of the groove 213-1.

A crankshaft 213-4 is extended below the thrusting and cutting blade 213 and interlocked with the thrusting and cutting blade 213 by link plates 213-5 to reciprocate the thrusting and cutting blade 213 in radial directions. A plurality of blowing holes 208-1 and 208-1′ (only the blowing holes 208-1 are shown ) are formed so as to open at positions between the grooves 210 and 210′ and the thrusting and cutting blades 213 and 213′ in the circumferences of the folding drums 208 and 208′, respectively. The suction grooves 213-2 formed in the side surfaces of the thrusting and cutting blade 213 are connected through an air passage 219 to a longitudinal suction passage 220 formed in the first folding drum 208.

Tubes P and P′ are fed to the folding drums 208 and 208′, sealed at equal intervals to form successive bags P-1 and P′-1 and then the tubes P and P′ are cut on the folding drums 208 and 208′ into individual bags P-1 and P′-1 in the same manner as that described previously with reference to the first and second embodiments. The trailing edge of the preceding bag P-1 (P′-1) and the leading edge of the succeeding bag P-1 (P′-1) are held securely by suction, respectively, on the side surfaces of the thrusting and cutting blade 213 (213′) of the first folding drum 208 (the second folding drum 208′) and carried to a position where the thrusting and cutting blade 213 (213′) coincides with the swing gripper 212′ (212) of the second folding drum 208′ (the first folding drum 208).

Then, the trailing edge of the preceding bag P-1 and the leading edge of the succeeding bag P-1 held on the thrusting and cutting blade 213 of the first folding drum 208 are thrusted, together with the middle portion of the bag P′-1 held on the second folding drum 208; into the grooves 210′ of the second folding drum 208′ by the thrusting and cutting blade 213 and, at the same time, the swing gripper 212′ swings toward the thrusting and cutting blade 213 to fold the middle portion of the bag P′-1.

In this state, the rotation of the folding drums 208 and 208′ is interrupted temporarily, and then the thrusting and cutting blade 213 is retracted beneath the circumference of the first folding drum 208 to allow the swing gripper 212′ of the second folding drum 208 to press the folded middle portion of the bag P′-1, the trailing edge of the preceding bag P-1 and the leading edge of the succeeding bag P-1 against the suction surface 214′ of the second folding drum 208′.

Then, the folding drums 208 and 208′ are started again for rotation and the swing gripper 212′ is turned in the opening direction to release the folded bag P′-1 and the trailing edge of the preceding bag P-1, which has been folded previously in the preceding folding cycle, and, at the same time, compressed air is blown through the blowing holes 208-1 of the first folding drum 208 to blow down the folded bags P-1 and P′-1. The compressed air blown through the blowing holes 208-1 (208-1′) surely delivers the folded bags P-1 and P′-1 downward and prevents the electrostatic adhesion of the folded bags P-1 and P′-1 to the folding drum 108 (208′).

Fourth Embodiment (FIGS. 23 to 29)

A bag folding machine in a fourth embodiment according to the present invention is characterized by thrusting means for thrusting tubes into groves formed in a pair of folding drums, and guide means provided under the pair of folding drums to guide folded bags delivered from the pair of folding drums.

Figure 23:
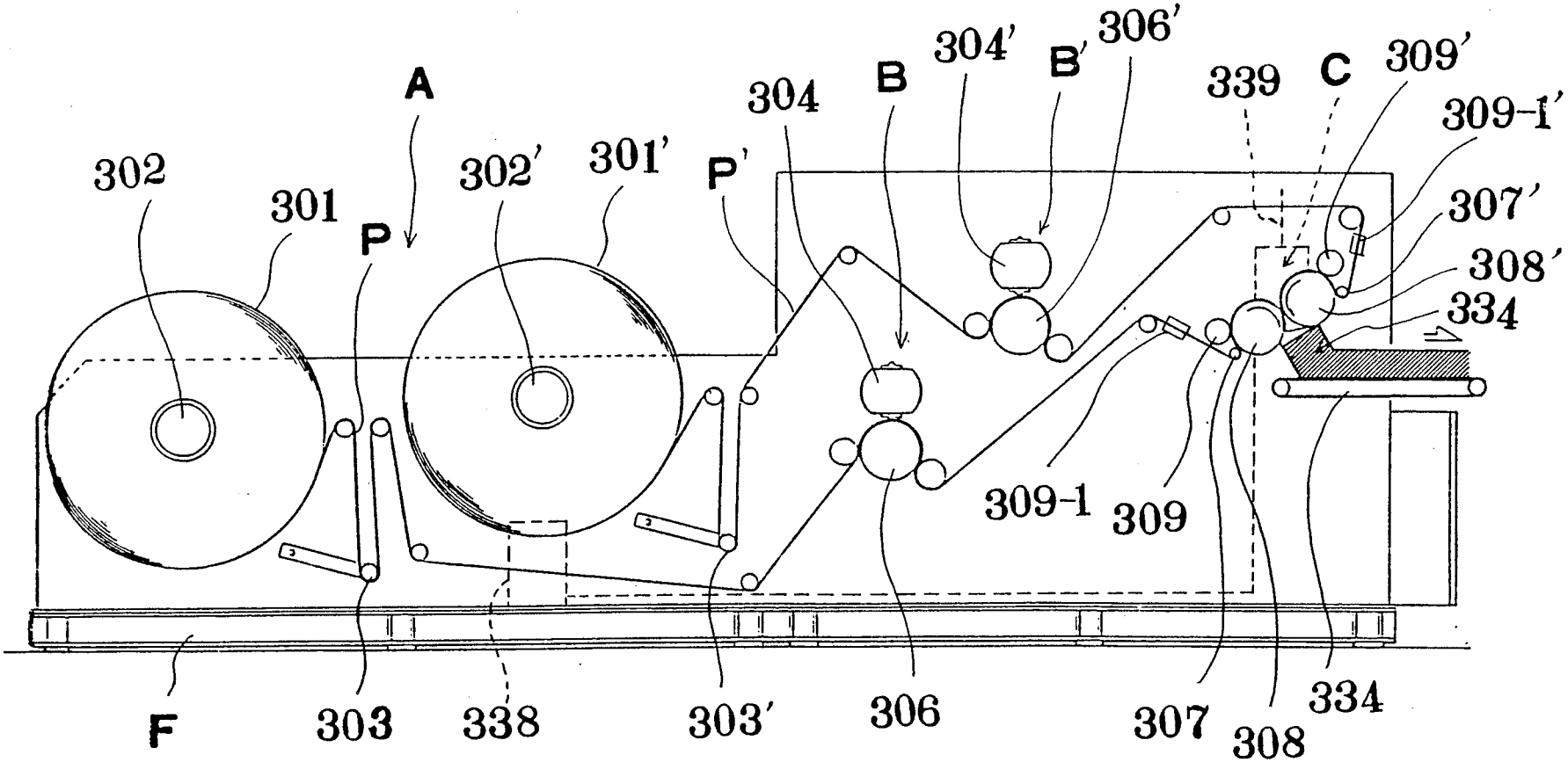
FIG. 23 is a side elevation of a bag folding machine in a fourth embodiment according to the present invention.

In FIGS. 23 to 29, parts like or corresponding to those previously described with reference to the first embodiment are denoted by the same reference numerals with the prefix "3". Referring to FIG. 23, the bag folding machine comprises a tube feed section A for feeding tubes P and P′, such as polyethylene tubes, sealing sections B and B′, and a bag folding section C arranged sequentially in that order.

In the tube feed section A, two tube rolls 301 and 302 are supported, respectively, on support shafts 302 and 302′ journaled on a frame F. The tubes unwound from the tube rolls 301 and 301′ are tightened properly, respectively, by tension rollers 303 and 303′.

Figure 24:
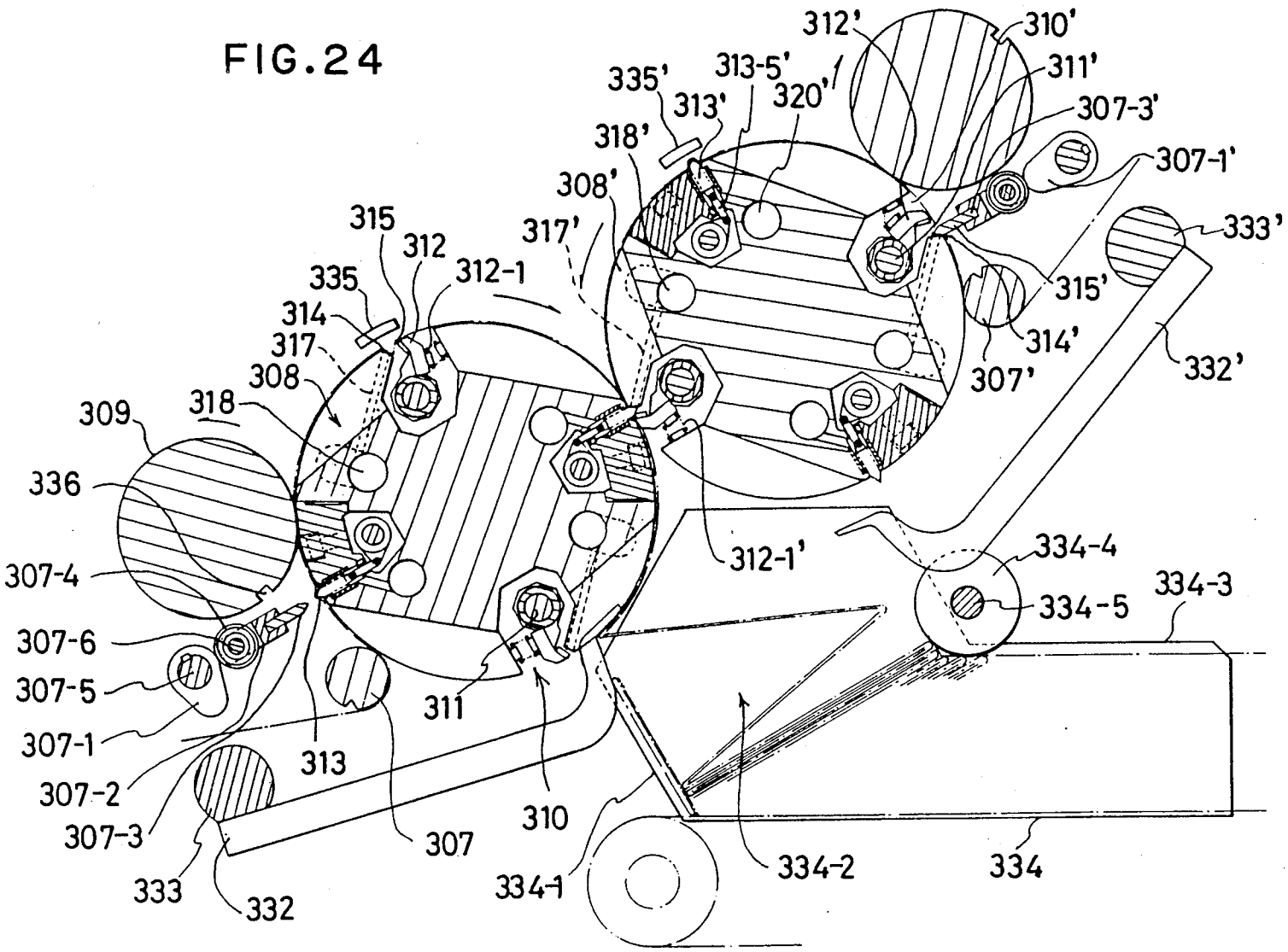
FIG. 24 is an enlarged sectional view of an essential portion of the bag folding machine in the fourth embodiment.

The sealing section B comprises a sealing heater 304 and feed roller 306 disposed opposite to the sealing heater 4 for a cooperative sealing operation to form sealed portions 305 across the tube P at regular intervals in the tube P as the tube P travels between the sealing heater 304 and the feed roller 306. The sealing section B′ is entirely the same as the sealing section B in construction and function; the sealing section B′ forms sealed portions 305 in the tube P′.

referring to FIG. 24, the bag folding section C comprises a first folding unit including a first folding drum 308, and a second folding unit including a second folding drum 308′ disposed adjacently to the first folding drum 308. The first folding unit and the second folding unit are identical in construction and function, except that the first folding unit and the second folding unit are in mirror-image relationship with each other, hence only the first folding unit including the first folding drum 308 will be described and the description of the second folding unit including the second folding drum 308′ will be omitted except when necessary.

The first folding unit comprises the first folding drum 308, a first rubber guide roller 307 disposed in rolling contact with the first folding drum 308 to guide the tube P to the first folding drum 308, a first rubber presser roller 309 for pressing the tube P against the circumference of the first folding drum 308, a thrust blade 307-3 disposed between the guide roller 307 and the presser roller 309, and a static eliminator 309-1 (FIG. 23) disposed before the guider roller 307 close to the tube P.

Two longitudinal grooves 301 are formed in the circumference of the first folding drum 308 at positions diametrically opposite to each other. A shaft 311 is extended within and along each of the grooves 310, and a swing gripper 312 is mounted on the shaft 311. The swing gripper is biased in the closing direction by a spring 312-1. The thrust blade 307-3 is mounted on a holding member 307-2. A cam follower 307-4 is supported on the holding member 307-2. A rotary cam 307-1 engages the cam follower 307-4 to drive the holding member 307-2 intermittently to thrust the tube P into the grooves 310 with the thrust blade 307-3.

Also shown in FIG. 24 is a cam shaft 307-5 on which the rotary cam 307-1 is mounted, a shaft 306-6 rotatably supporting the cam follower 307-4 and an extension spring 307-7 for securing the engagement of the cam follower 307-4 and the rotary cam 307-1. Thrusting and cutting blades 313 are provided in the circumference of the first folding drum 308 at positions diametrically opposite to each other and spaced 90° apart from the swing grippers 312. A cutting blade 335 is disposed above the first folding drum 308 to cut the tube P in cooperation with the thrusting and cutting blades 313.

Figure 29:
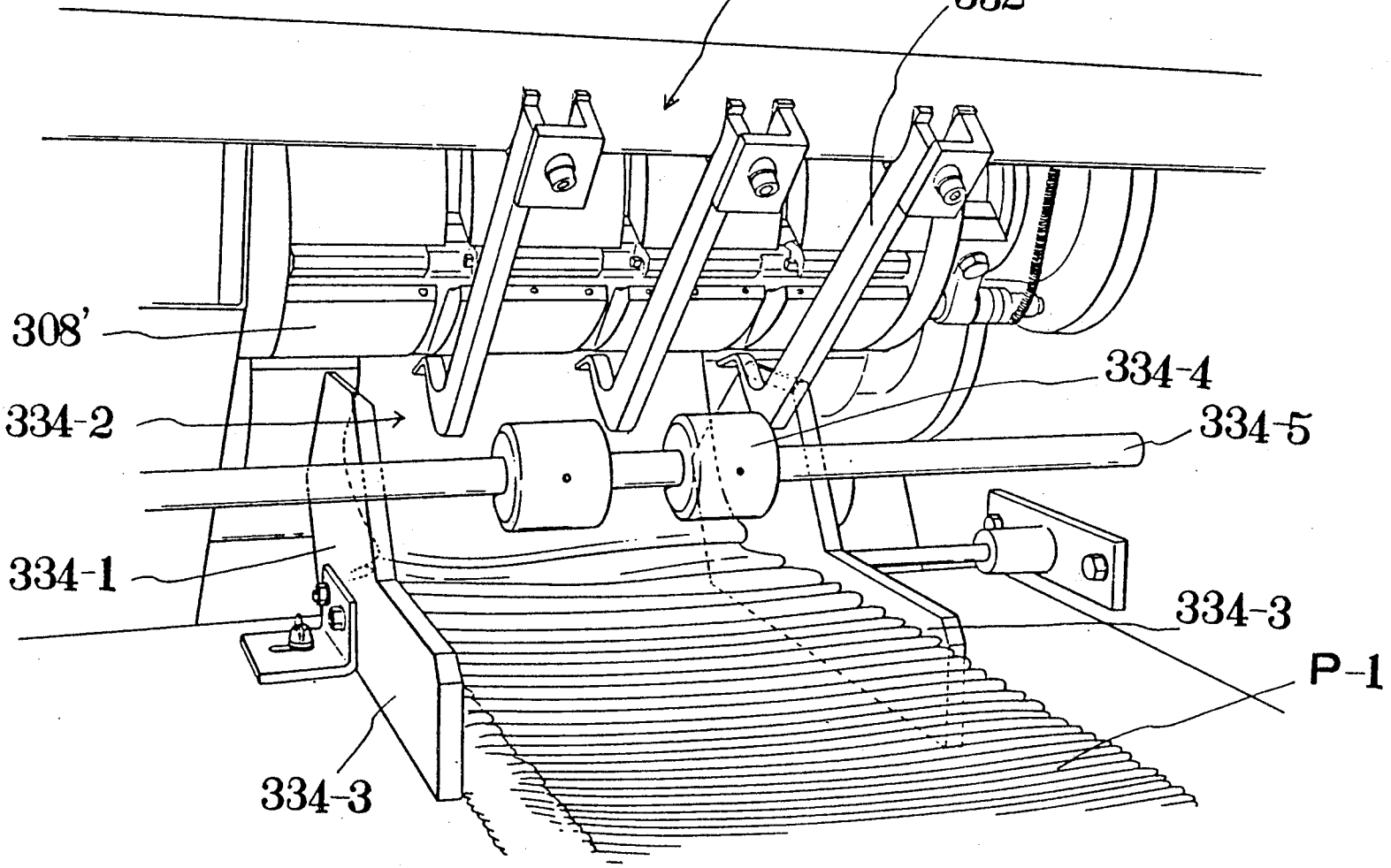
FIG. 29 is a perspective view of guide plates defining place for receiving folded bags.

Referring to FIG. 29, guide plates 334-3 having a shape resembling the letter L are disposed respectively, on the opposite sides of a conveyor belt 334 with the upper ends thereof positioned near the first folding drum 308 to receive folded bags therebetween. Delivery rollers 334-4 are mounted on a support shaft 334-5 extended in parallel to the axes of the folding drums 308 and 308' and above the rear portions of the guide plates 334-3.

Referring again to FIG. 24, a longitudinal groove 336 is formed in the circumference of the presser roller 309. A flow-change valve plate 321 is placed in sliding contact with the end surface of the first folding drum 308 and is pressed constantly against the end surface of the first folding drum 308 by a compression spring 337.

Referring again to FIG. 23, a vacuum pump 338 is connected to the respective suction passages 322 and 322' of the flow-change valve plates 321 and 321'. A pipe 339 for supplying compressed air is connected to the respective blowing passage 323 and 323' of the flow-change valve plates 321 and 321'.

In operation, the tubes P and P' supported on the support shafts 302 and 302' are fed to the sealing sections B and B' while the tension rollers 302 and 302' control the tension of the tubes P and P' properly as shown in FIG. 23.

Figure 25:
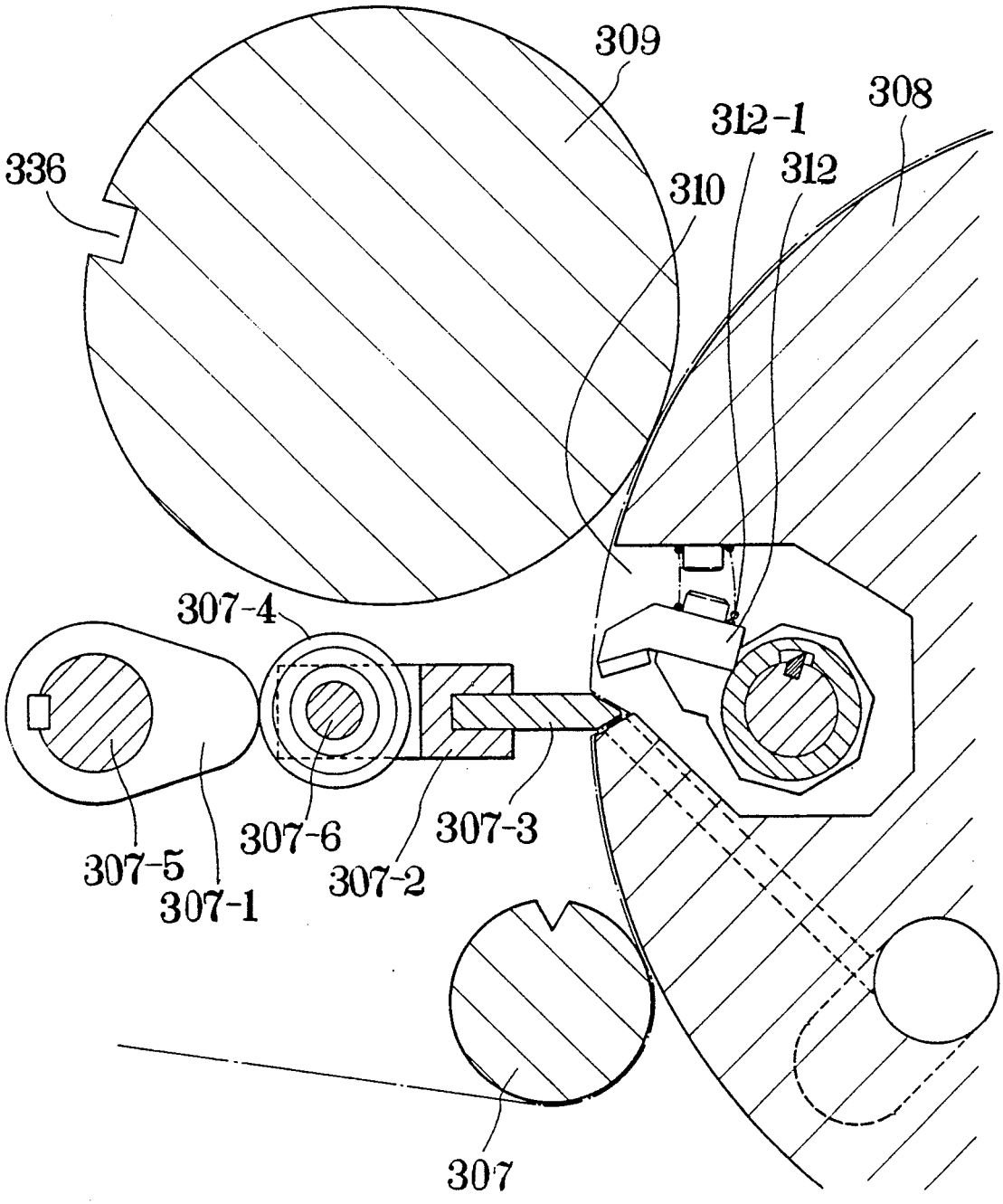
FIGS. 25, 26, 27 and 28 are an enlarged sectional view, a plan view, a detail plan view and sectional view, respectively, of an essential portion of the bag folding machine in the fourth embodiment.
Figure 26:
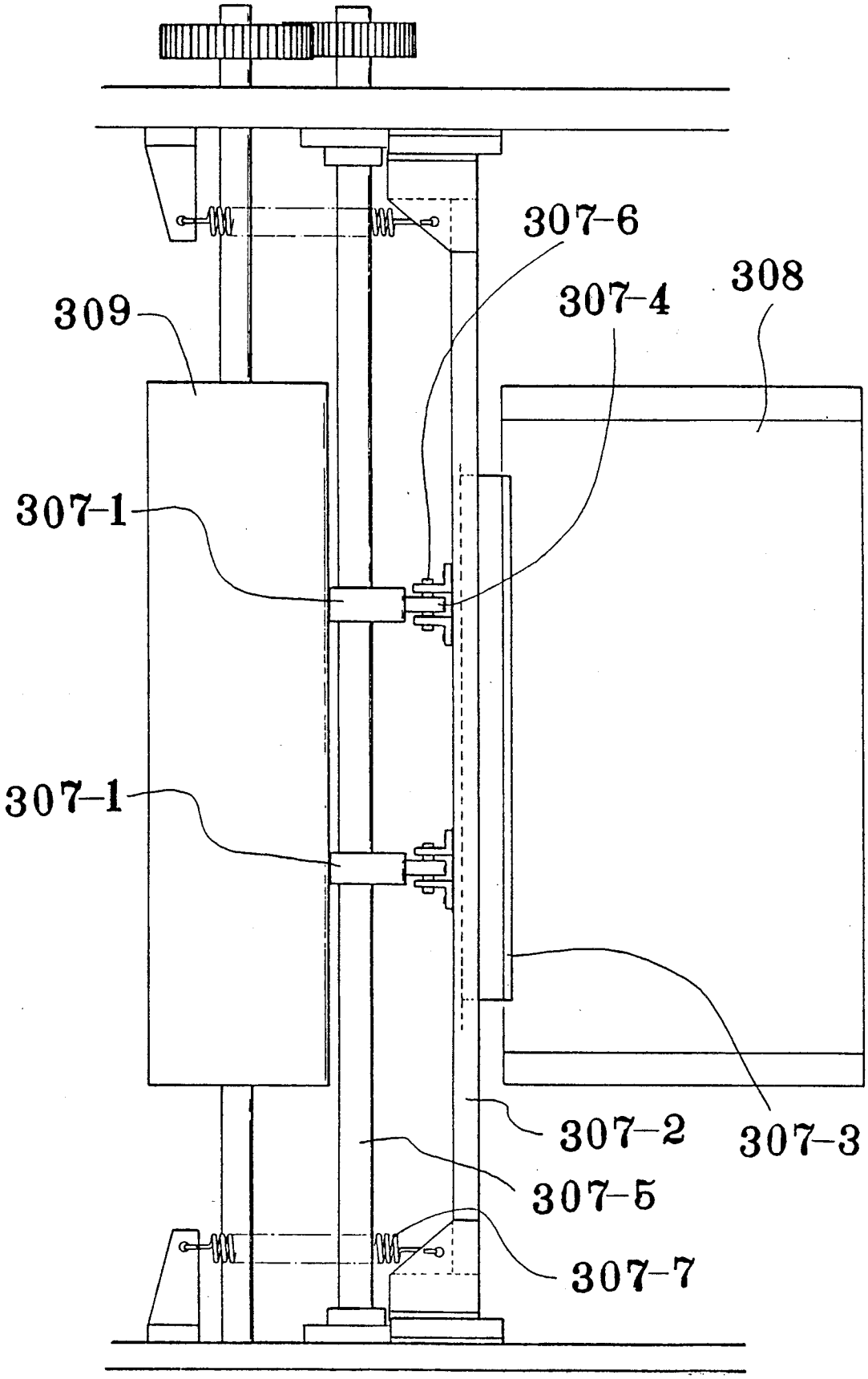
Figure 27:
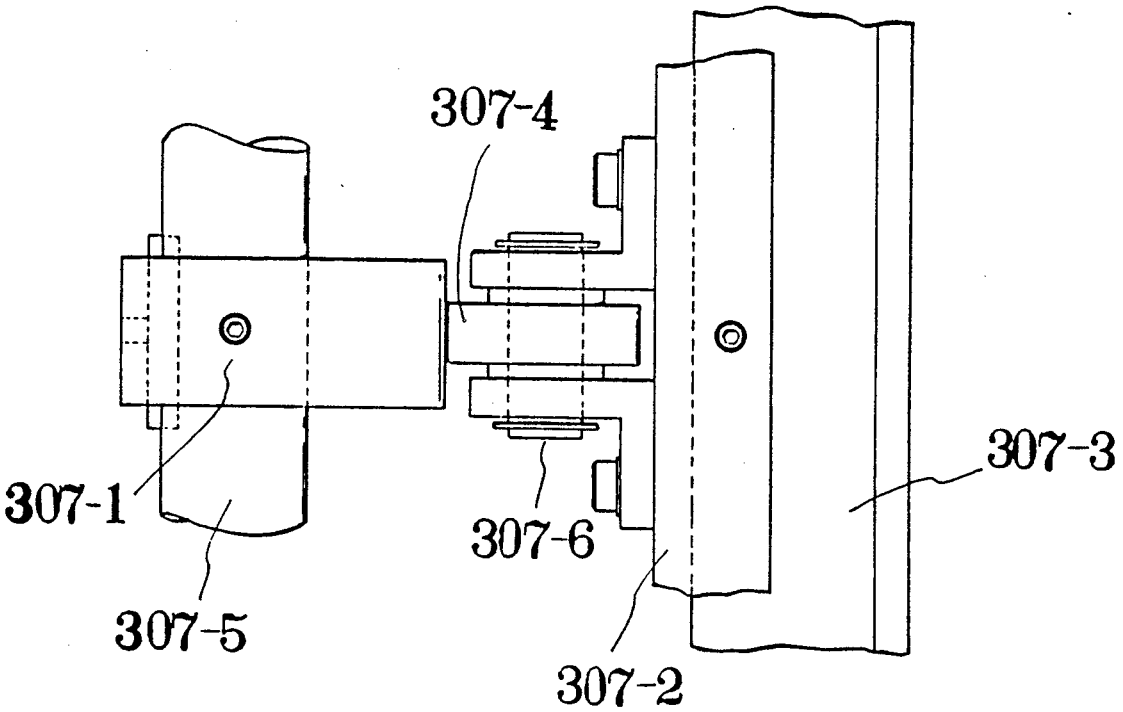
Figure 28:
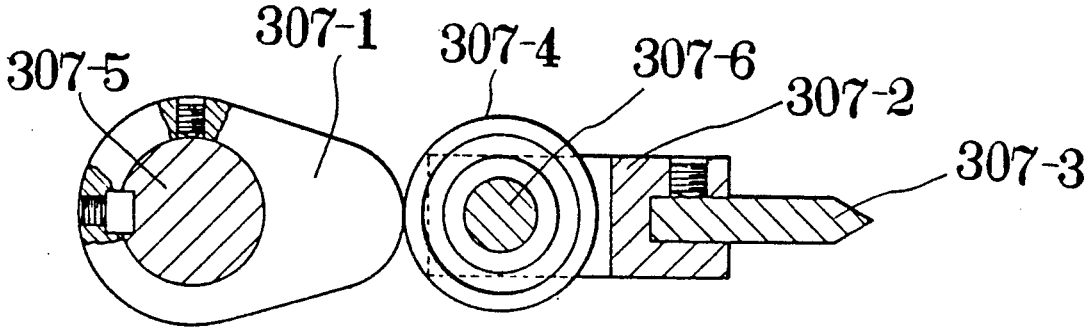

The sealing section B (B') forms sealed portions in the tube P (P') at equal intervals by the cooperative sealing action of the feed roller 306 (306') and the sealing heater 304 (304'). Static electricity is eliminated from the tube P (P') by the static eliminator 309-1 (309-1') while the tube P (P') is being fed to the first-folding drum 308 (the second folding drum 308') through the guide roller 307 (307'). As shown in FIG. 25, the thrust blade 307-3 is advanced toward the first folding drum 308 by the rotary cam 307-1 upon the arrival of the groove 310 at a position corresponding to the thrust blade 307-3 to thrust the tube P into the groove 310. A portion of the tube P thrusted into the groove 310 is attracted to and held on a suction surface 314 by the suction of air sucked through suction holes 315 formed in the suction surface 314. The presser roller 309 presses the tube P against the circumference of the first folding drum 308 so that the tube P extends closely along the circumference of the first folding drum 308.

As shown in FIG. 29, folded bags P-1 and P'-1 delivered from the folding drums 308 and 308' to the space 334-1 between the guide plates 334-3 are conveyed backward (to the right as viewed in FIG. 29) along the guide plates 334-3 by the conveyor belt 334, while the delivery rollers 334-4 obstruct the backward movement of the upper portions of the folded bags P-1 and P'-1, so that the folded bags P-1 and P'-1 are stacked obliquely. A predetermined number of folded bags are packed in a package for delivery.

Thus, the tube P (P') fed through the guide roller 307 (307') to the first folding drum 308 (the second folding drum 308') is thrusted into the grooves 310 (310') of the first folding drum 308 (the second folding drum 308') by the thrust blade 307-2 (307-2') which is reciprocated intermittently by the rotary cam 307-1 (307-1'). Therefore, the tube P (P') can be surely thrusted into the grooves 310 (310') and the folded middle portion of the tube P (P') can be securely held by suction on the suction surface 314 (314') formed in the side wall of the groove 310 (310'). Accordingly, the bags P-1 and P'-1 never fall accidentally off the folding drums 308 and 308' and hence the bag folding machine is able to operate smoothly and efficiently for high-speed bag folding operation.

Furthermore, the guide plates 334-3 disposed under the folding drums 308 and 308' and the pressing arms 332 and 332', and the delivery rollers 334-4 disposed above the rear portions of the guide plates 334-3 enable partially overlapping folded bags P-1 and P'-1 delivered alternately from the folding drums 308 and 308' to be stacked regularly on and conveyed smoothly by the conveyor belt 334 extended between the guide plates 334-3, so that a predetermined number of the partially overlapping folded bags can be efficiently packed in packages.

Still further, the bag folding machine employs the rubber guide rollers 307 and 307' for guiding the tubes P and P' to the folding drums 308 and 308', and the static eliminators 309-1 and 309-1' disposed close to the tubes P and P' at positions before the guide rollers 307 and 307', respectively. Static electricity is eliminated perfectly from the tubes P and P' fed by the tube feed section A before the tubes P and P' are fed through the guide rollers 307 and 307' to the folding drums 308 and 308'. Accordingly, the tubes P and P' never wrap around the guide rollers 307 and 307' and are never creased on the circumferences of the folding drums 308 and 308', hence the tubes P and P' can be smoothly cut into bags and the bags are folded satisfactorily without fail.

Moreover, since the presser rollers 309 and 309' for pressing the tubes P and P' against the circumferences of the folding drums 308 and 308' are rubber rollers, the tubes P and P' can be surely extended in close contact with the circumferences of the folding drums 308 and 308', respectively.

What is claimed is:

1. A bag folding machine comprising:

(a) a pair of folding drums having equal sizes and mirror-image constructions and supported for rotation and means for rotating the drums at the same rate but in opposite directions, (b) longitudinal grooves formed in the circumferences of the folding drums at equal circumferential intervals, respectively, each said groove having a pair of side walls, (c) swing grippers supported for swing motion in the longitudinal grooves, respectively, said swing grippers having the proximal ends thereof fixed to shafts passing through said longitudinal grooves, said shafts being interlockingly rotatable in said longitudinal grooves with the rotation of said folding drums for periodically pivoting said swing grippers toward a radially outermost end of one of said side walls of each said groove, (d) thrusting and cutting blades provided in the circumferences of the folding drums, respectively, said thrusting and cutting blades being of the same number as said longitudinal grooves, each said thrusting and cutting blade being disposed in between each two of said longitudinal grooves of the same folding drum, each said thrusting and cutting blade having a wedge-like head, (e) suction means for holding tubes onto the circumferences of said folding drums by suction, said suction means comprising suction passages which each have one end thereof opened at the distal end of a respective said thrusting and cutting blades and another end communicating with a longitudinal suction passage formed in a respective said folding drum and suction passages which each have one end thereof opened at a radially outermost end of one of said side walls of each said groove and another end communicating with a respective longitudinal suction passage, and (f) cutting blades disposed along the circumference of said folding drums for cutting tubes cooperatively with said thrusting and cutting blades, a rotational phase difference between the folding drums being determined so that the longitudinal grooves and the thrusting and cutting blades of one folding drum coincide with the thrusting and cutting blades and longitudinal grooves of the other folding drum at the point of tangency of the folding drums so as to firmly hold cut tubes on the circumferences of said folding drums by the coupled effect of said swing grippers and said suction passages.

2. A bag folding machine according to claim 1, wherein a pair of pressing arms for pressing down folded bags delivered from said pair of folding drums are disposed below said pair of folding drums and a pair of guide plates having a shape resembling the letter L are disposed under said pressing arms to guide folded bags delivered from the folding drums in a regular arrangement.

3. A bag folding machine according to claim 1, wherein auxiliary thrust rollers are disposed near said folding drums to thrust the middle portions of respective bags into the respective longitudinal grooves of the respective folding drums.

* * * * *